US011020629B2

(12) United States Patent
Liao et al.

(10) Patent No.: US 11,020,629 B2
(45) Date of Patent: Jun. 1, 2021

(54) STATIONARY EXERCISE APPARATUS

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech. Co., Ltd., Taichung (TW)

( * ) Notice: Subject to any disclaimer, the term of this patent is extended or adjusted under 35 U.S.C. 154(b) by 73 days.

(21) Appl. No.: 16/285,112

(22) Filed: Feb. 25, 2019

(65) Prior Publication Data

US 2020/0269086 A1 Aug. 27, 2020

(51) Int. Cl.

| | |
|---|---|
| ***A63B 22/04*** | (2006.01) |
| ***A63B 22/06*** | (2006.01) |
| ***A63B 22/00*** | (2006.01) |
| ***A63B 23/035*** | (2006.01) |

(52) U.S. Cl.

CPC ..... *A63B 22/04* (2013.01); *A63B 22/001* (2013.01); *A63B 22/0664* (2013.01); *A63B 23/03541* (2013.01)

(58) Field of Classification Search

CPC ..... A63B 22/04; A63B 22/08; A63B 22/00; A63B 69/16; A63B 22/06; A63B 22/001; A63B 22/0664; A63B 23/03541; A63B 21/00058; A63B 21/225; A63B 21/00069; A63B 21/00072; A63B 21/22; A63B 21/5027; A63B 22/0015; A63B 21/4034; A63B 22/0023; A63B 22/0056; A63B 22/205; A63B 24/00; A63B 2022/0051; A63B 2022/067; A63B 2022/0676; A63B 2022/206; A63B 2225/09

See application file for complete search history.

(56) References Cited

U.S. PATENT DOCUMENTS

| | | | | |
|---|---|---|---|---|
| 5,919,118 | A * | 7/1999 | Stearns | A63B 22/001 482/51 |
| 7,972,248 | B2 | 7/2011 | Liao et al. | |
| 10,814,160 | B2 * | 10/2020 | Liao | A63B 21/225 |
| 2015/0202488 | A1 * | 7/2015 | Lo | A63B 22/001 482/52 |

FOREIGN PATENT DOCUMENTS

| | | |
|---|---|---|
| CN | 107789794 A | 3/2018 |
| TW | I549720 B | 5/2016 |

* cited by examiner

*Primary Examiner* — Nyca T Nguyen
*Assistant Examiner* — Andrew M Kobylarz

(57) ABSTRACT

According to one aspect of the present disclosure, a stationary exercise apparatus which not only can a user exercise alternately with one leg lifting and the other leg pressing but the exercising paths thereof are capable of being adjusted so that the user is capable of exercising with different postures and motions and having more abundant exercise types. For the sake of safety, stability, and convenience, the supporting portions for the user to step on have specific orientation angles and don't rotate arbitrarily to different positions at every point of the exercising path.

7 Claims, 22 Drawing Sheets

STATIONARY EXERCISE APPARATUS

BACKGROUND

1. Field of the Invention

This present disclosure relates to a stationary exercise apparatus, and more particularly to a leg exercise apparatus.

2. Description of Related Art

Stationary exercise apparatuses have been popular for several decades. Early exercise apparatuses typically had a single mode of operation, and exercise intensity was typically varied by increasing apparatus speed or by increasing resistance to motion. More recently, enhancing exercise intensity in some apparatuses has been made by adjusting the moving path of a user's feet, such as by adjusting the incline or stride length of a user's foot path.

FIGS. 1 and 2 illustrate a conventional exercise apparatus 90. The exercise apparatus 90 includes a frame 91, a grip set 92, a seat portion 93, a left rotating arm 95L, a right rotating arm 95R, a left pedal 96L, and a right pedal 96R. The rotating arms 95L/95R are capable of rotating around an axle A which is extending generally transversely (from left to right) relative to the frame 91, and the left pedal 96L and the right pedal 96R are respectively set at the bottom ends of the rotating arms 95L/95R. From the side view of the exercise apparatus 90, along with the rotation of the rotating arms 95L/95R, the pedals 96L/96R are capable of moving along an arc path T about an arc center A' which is a portion of the axle A. Based on the predetermined stop positions S/S', the extremely forward position of each of the pedals 96L/96R is the position forward of the arc center A', and the extremely rearward position of each of the pedals 96L/96R is the position below the arc center A'.

Furthermore, a linkage arrangement (not shown) is set between the rotating arms 95L/95R so that when one of the rotating arms 95L/95R is rotating forward, the other one of the rotating arms 95L/95R is rotating rearward. When no external force is applied to the exercise apparatus 90, the rotating arms 95L/95R will generally come to a rest position where the rotating arms are aligned with one another as shown in FIG. 1.

Referring to FIG. 2, while using the exercise apparatus 90, a user U is gripping the grip set 92, standing on the pedals 96L/96R, and alternately moving with one leg lifting and the other leg pressing onto one of the pedals 96L/96R. During the exercise, the arc path T is fixed, the upper body of the user is substantially motionless, and the exercise effect is limited to exercise of only the lower body.

Furthermore, because the pedals 96L/96R are pivotally connected to the bottom ends of the rotating arms 95L/95R, the upper faces thereof are rotated freely according to the feet positions of the user U. The seat portion 93 becomes necessary to be an auxiliary portion for the user U climbing on the exercise apparatus 90 and then adjusting his (her) feet to fit on the pedals. In other words, the pedals 96L/96R are unstable, especially when the user U steps on and off the exercise apparatus 90.

SUMMARY

According to one aspect of the present disclosure, an stationary exercise apparatus is disclosed in which a user can exercise by alternately lifting one leg and pressing down with the other leg, and additionally, the exercising paths thereof are capable of being adjusted so that the user is capable of exercising with different postures and motions and having more abundant exercise types. For the sake of safety, stability, and convenience, the supporting portions for supporting the user have specific orientation angles and do not rotate arbitrarily to different positions at every point of the exercising path.

According to another aspect of the present disclosure, a stationary exercise apparatus is provided for a user exercising with arms and legs simultaneously.

According to one aspect of the present disclosure, a stationary exercise apparatus includes a frame; a supporting member set on the frame and capable of being adjustably positioned at one of a plurality of predetermined positions; a left moving assembly and a right moving assembly, each of the moving assemblies including a first swing element which includes a first pivot pivotally connected to the supporting member, movably positioned relative to the frame by the supporting member, and defining a first axis; and a first swing portion pivotable around the first axis to move along a first arc path; and a second swing element which includes a second pivot pivotally connected to the frame and defining a second axis and a second swing portion pivotable around the second axis to move along a second arc path; and a supporting element which includes a first pivot portion pivotally connected to the first swing portion; a second pivot portion pivotally connected to the second swing portion; and a supporting portion for supporting a user and moving along a reciprocating path defined by the respective motions of the first swing element and the second swing element; and a linkage arrangement connected to the left moving assembly and the right moving assembly so that the supporting elements capable of being interposed at a rest position of the reciprocating path from the side view of the stationary exercise apparatus; wherein when one of the supporting portions is moving from the rest position toward a front end of the reciprocating path, the other supporting portion is moving from the rest position toward a rear end of the reciprocating path; wherein when the position of the supporting member relative to the frame is changed, the reciprocating path is changed accordingly.

According to another aspect of the present disclosure, the second swing element includes a grip portion, and the grip portion is capable of swinging along a third arc path according to the swing of the second swing portion of the second swing element.

BRIEF DESCRIPTION OF THE DRAWINGS

FIGS. 4A-6A are path information and geometry parameters of the supporting elements in the first position, in the second position, and in the third position respectively, in accordance with the first embodiment of the present disclosure in FIGS. 4-6;

FIGS. 4B-6B are path information and geometry parameters of the second swing elements in the first position, in the second position, and in the third position respectively, in accordance with the first embodiment of the present disclosure in FIGS. 4/4A-6/6A;

FIGS. 8A-10A are path information and geometry parameters of the first and second swing elements in the first position, in the second position, and in the third position respectively, in accordance with the second embodiments of the present disclosure in FIGS. 8A-10A;

DETAIL DESCRIPTION

Figure 1:
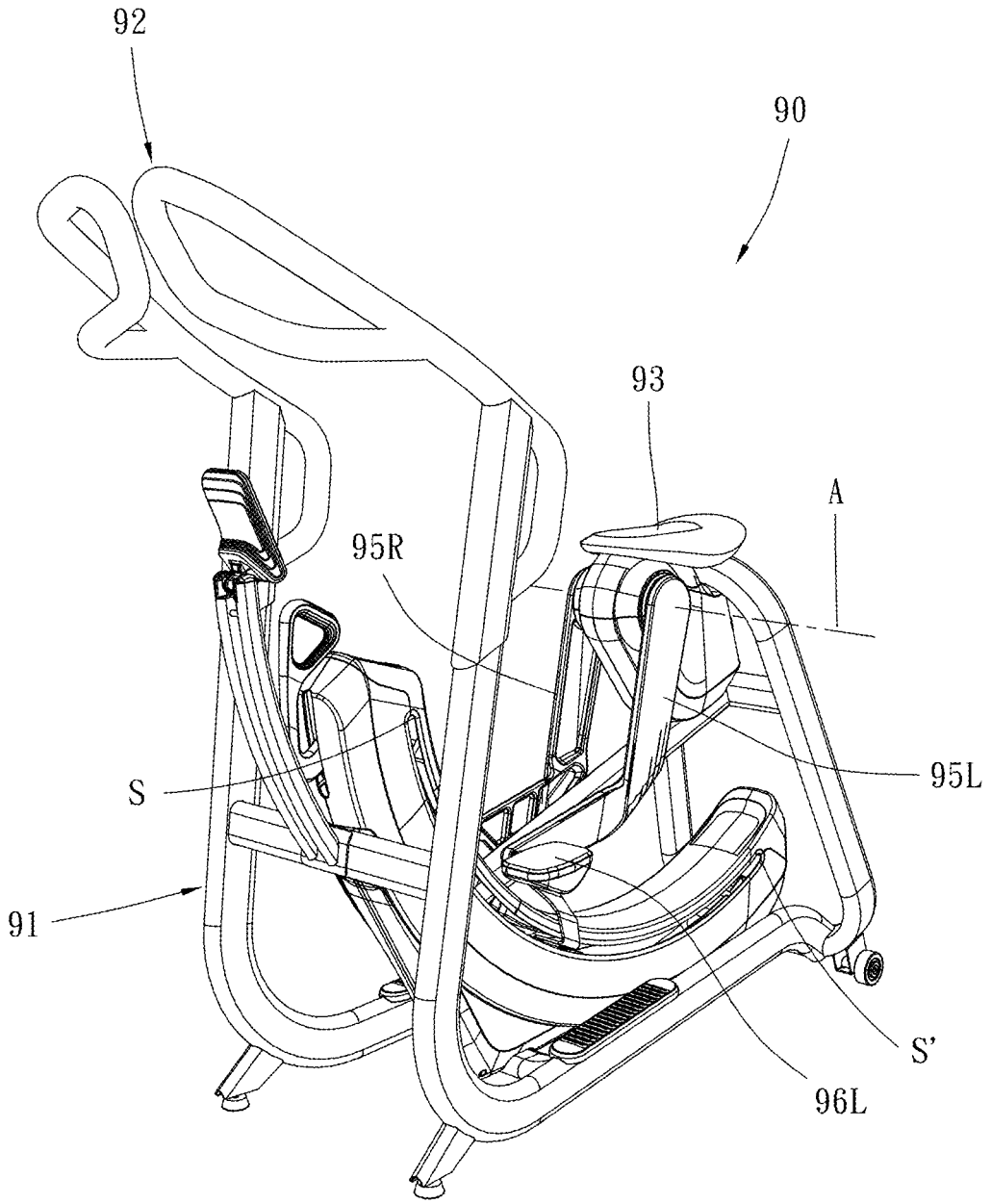
FIG. 1 PRIOR ART
FIG. 1 is a perspective view of a conventional exercise apparatus showing the rotating arms in their rest position with the rotating arms aligned with one another.

Referring now specifically to the figures, in which identical or similar parts are designated by the same reference numerals throughout, a detailed description of the present disclosure is given. It should be understood that the following detailed description relates to the best presently known embodiment of the disclosure. However, the present disclosure can assume numerous other embodiments, as will become apparent to those skilled in the art, without departing from the appended claims.

Figure 3:
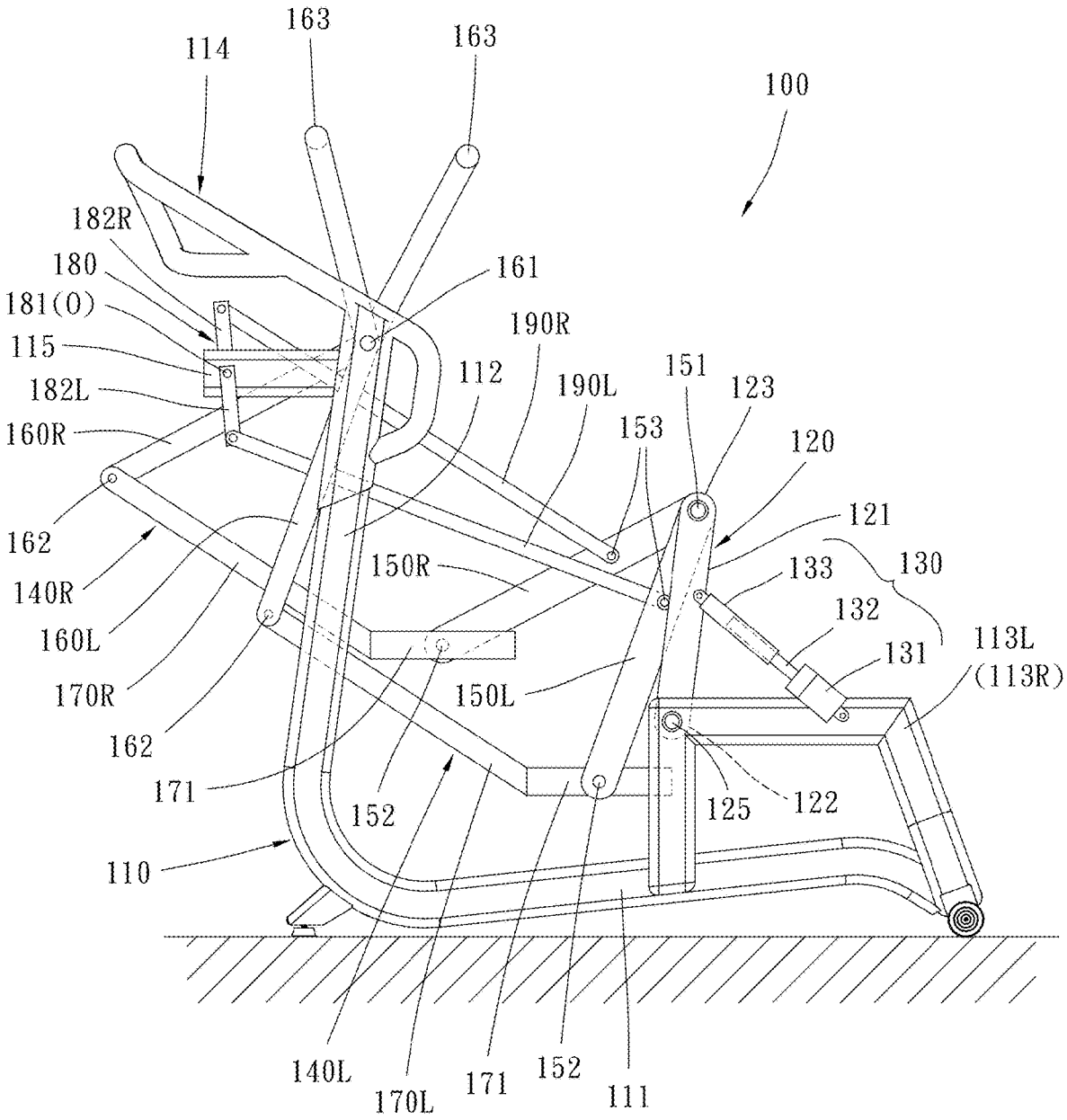
FIG. 3 is a side view of a stationary exercise apparatus in a first position in accordance with the first embodiment of the present disclosure with the supporting portions shown not aligned.

FIG. 3 is a side view of a stationary exercise apparatus 100 according to the first embodiment of the present disclosure. In FIG. 3, the stationary exercise apparatus 100 has a frame 110 generally including a base 111, a front portion 112, a left side portion 113L, and a right side portion 113R (Side portions 113L/113R are aligned with one another and the right side portion 113R is omitted from the side view). One user could step on and off the stationary exercise apparatus 100 from the rear side of the frame 110 by entering and leaving an accessible space located between the side portions 113L/113R. The top end of the front portion 112 includes a grip set 114 for the user to grip.

The frame 110 further includes a supporting member 120 whose position relative to the frame 110 is adjustable. The supporting member 120 includes two corresponding deflecting poles 121. (Deflecting poles 121 are aligned with one another and one is omitted from the side view.) Each of the deflecting poles 121 includes one pivoting axis end 122 and one deflecting end 123 and is pivotally connected to the corresponding side portion 113L/113R of the frame 110 at an adjusting pivot 125 which is extending generally transversely (from left to right) relative to the frame 110 so that when the deflecting poles 121 deflect around the first adjusting pivot 125, the deflecting ends 123 move forward and rearward.

Figure 4:
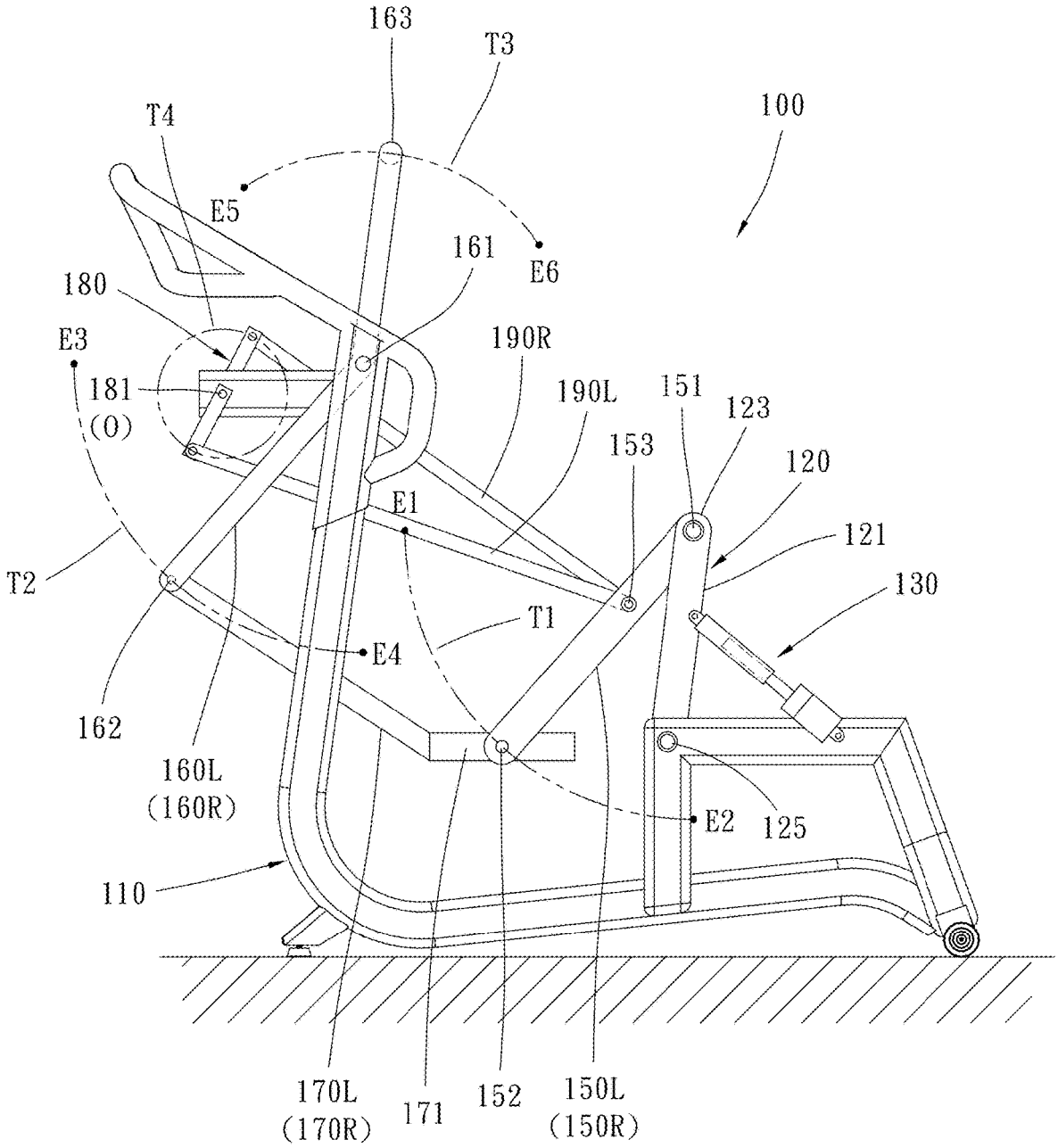
FIG. 4 is a side view of a stationary exercise apparatus of FIG. 3 with the supporting portions shown aligned with one another.
Figure 5:
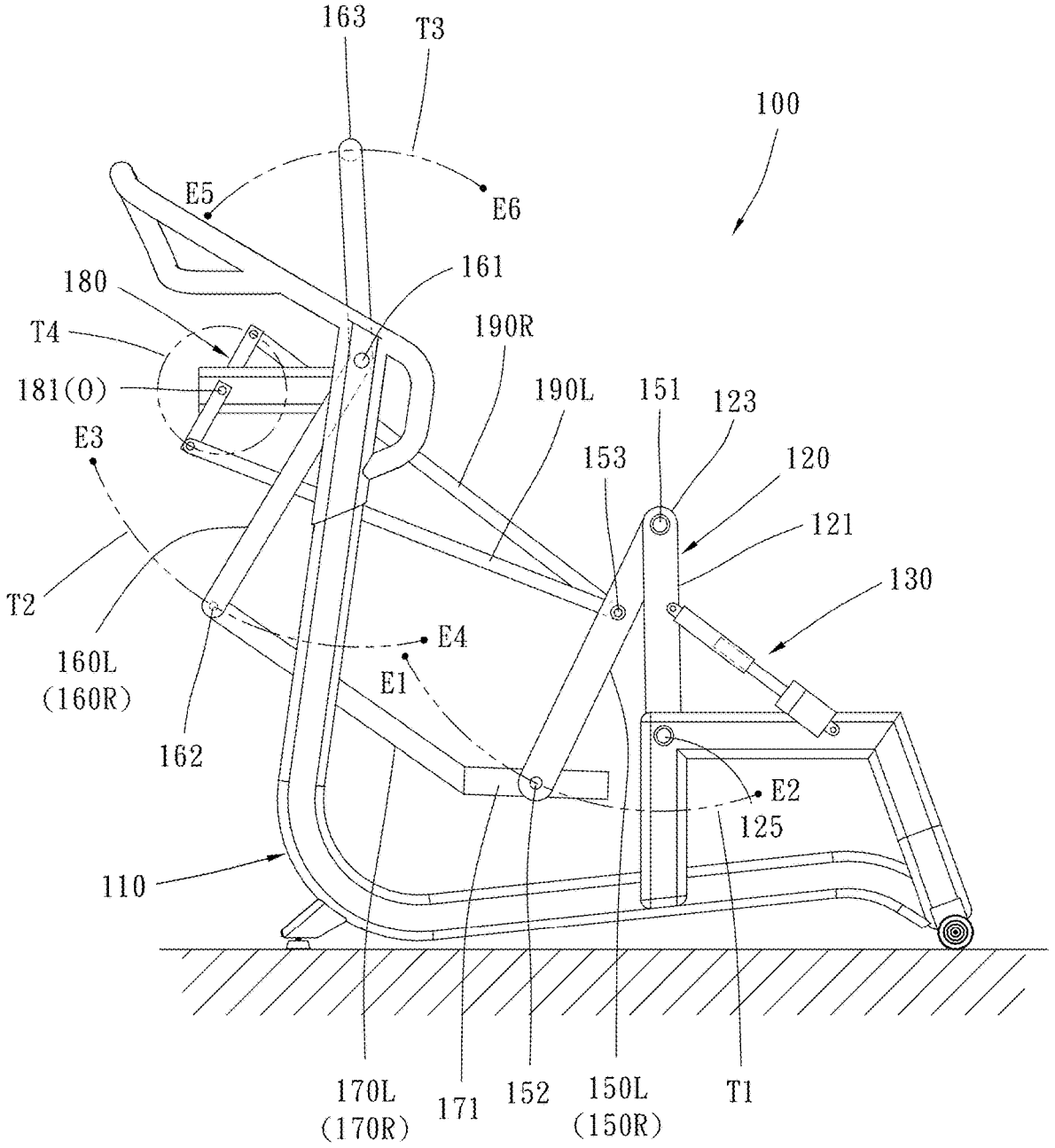
FIG. 5 is a side view of a stationary exercise apparatus in a second position in accordance with the first embodiment of the present disclosure and with the supporting portions shown aligned with one another.
Figure 6:
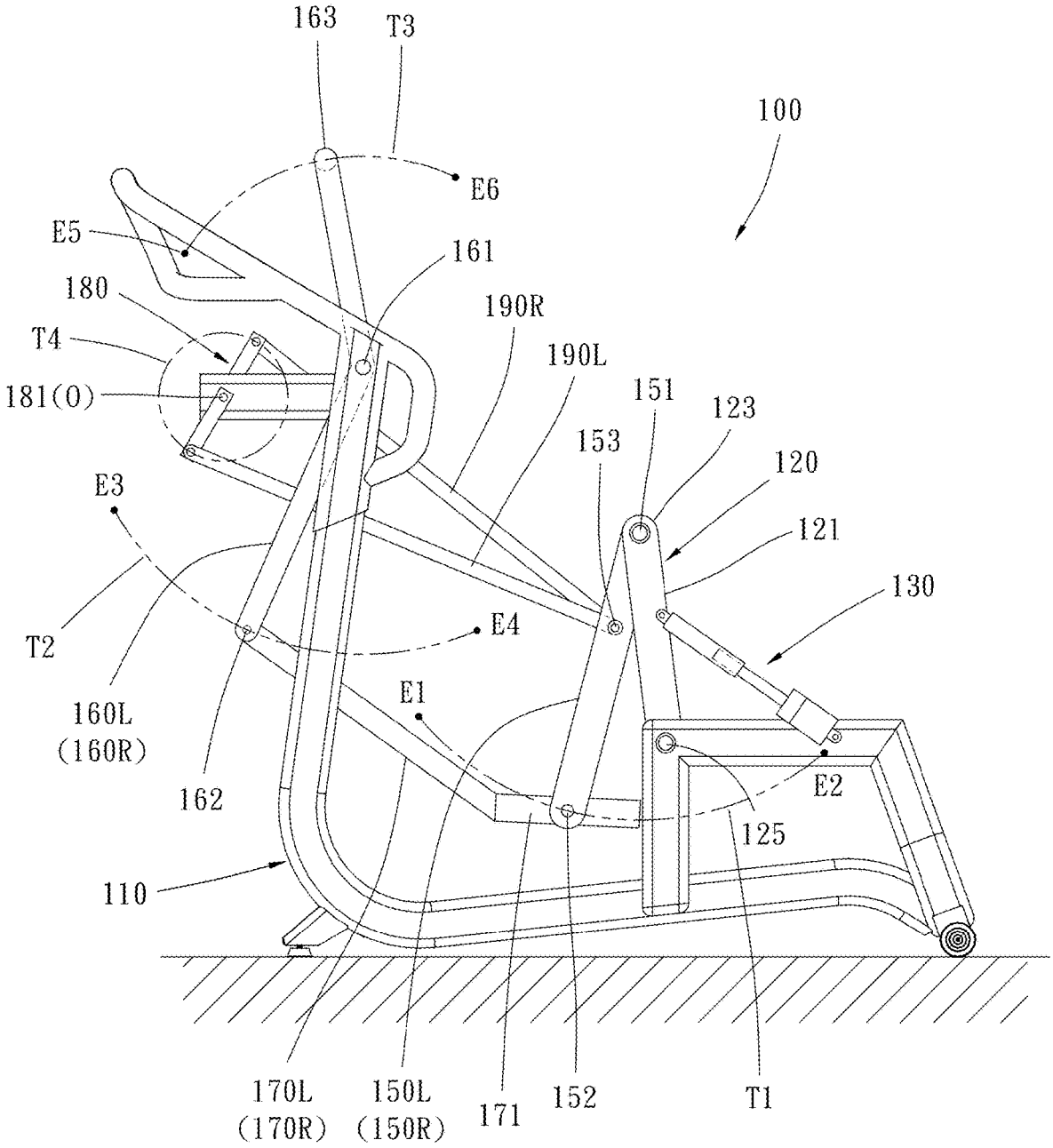
FIG. 6 is a side view of a stationary exercise apparatus in a third position in accordance with the first embodiment of the present disclosure and with the supporting portions shown aligned with one another.

In the present embodiment, a driving assembly 130 is mounted between the frame 110 (side portions 113L/113R) and the supporting member 120 for adjusting the position the supporting member 120 relative to the frame 110. In other words, the supporting member 120 is capable of being adjustably positioned at one of several predetermined positions relative to the frame 110. The driving assembly 130 drives the deflecting poles 121 deflecting around the first adjusting pivot 125 simultaneously so that the deflecting poles 121 are located at a first position as shown in FIGS. 3 and 4, at a second position as shown in FIG. 5, and at a third position as shown in FIG. 6. As can be seen, from the first position to the third position, the deflecting ends 123 are moved forward gradually.

The driving assembly 130 includes a motor 131, a screw rod 132, and a screw tube 133. The motor 131 has one end connected to the frame 110 (side portions 113L/113R) and the other end connected to one end of the screw rod 132. The other end of the screw rod 132 is connected to one end of the screw tube 133. The other end of the screw tube 133 is connected to the supporting member 120. Therefore the effective length of the screw rod 132 and the screw tube 133 combination is adjustable to move the deflecting poles 121 fore and aft. In the embodiment, the supporting member 120 is capable of changing its position relative to the frame 110 and being located at one of several predetermined positions. Although described as a screw adjusting mechanism, the driving assembly 130 could be any manual or automatic mechanical, electromechanical, hydraulic, or pneumatic device is also within the scope of the invention. Furthermore, the driving assembly 130 can be controlled via a console (not shown) to vary the position of the supporting member 120.

Further referring to FIG. 4, a left first swing element 150L and a right first swing element 150R are pivotally connected to the supporting member 120. Each of the first swing elements 150L/150R includes a top end and a bottom end, the first pivot portion 151 is located at the top end, and a first swing portion 152 is located at the bottom end. The first pivot portion 151 is corresponding to a first axis (not shown) which is extending generally transversely (from left to right) relative to the frame 110 so that the first swing elements 150L/150R are capable of rotating along a first arc path T1. In other words, the first swing portions 152 are pivotable around the first axis to move along the first arc path T1 relative to the frame 110. In one embodiment of the present disclosure, the first axis doesn't extend exactly transversely (from left to right) relative to the frame so that the displacements of the first portions 152 include left and right movements. For example, when one first swing portion 152 moves forward, it also moves inward; when one first swing portion 152 moves rearward, it also moves outward. Furthermore, a linkage portion 153 is set between the top end and the bottom end of each first swing element 150L/150R.

Still referring to FIGS. 3 and 4, a left second swing element 160L and a right second swing element 160R are set in front of the first swing elements 150L/150R. Each of the second swing elements 160L/160R includes a top end, a bottom end, a second pivot 161 located at the top end, and a second swing portion 162 located at the bottom end. The second pivot 161 is pivotally connected to the front portion 112 around a second axis (not shown) which is extending generally transversely (from left to right) relative to the frame 110 so that the second swing elements 160L/160R are capable of rotating along a second arc path T2 from the side view. In other words, the second swing portions 162 are pivotable around the second axis to move along the second arc path T2 relative to the frame 110. In one embodiment of the present disclosure, the second axis doesn't extend exactly transversely (from left to right) relative to the frame 110 so that the displacements of the second portions 162 include left and right movements. For example, when one second swing portion 162 moves forward, it also moves inward; when one second swing portion 162 moves rearward, it also moves outward. Furthermore, each top end of the second swing elements 160L/160R includes a grip portion 163, and each grip portion 163 is pivotable about the second pivot 161 to swing along a third arc path T3 accordingly. In the present embodiment, when the grip portion 163 is moving forward/rearward, the corresponding second swing portion 162 is moving rearward/forward.

Each first swing element 150L/150R and the corresponding second swing element 160L/160R are connected to a corresponding supporting element 170L/170R. Each supporting element 170L/170R includes a front end and a rear end, the rear end of each supporting element 170L/170R is pivotally connected to the corresponding first swing portion 152, and the front end of each supporting element 170L/170R is pivotally connected to the corresponding second swing portion 162. Therefore, each first swing element 150L/150R and the corresponding second swing element 160L/160R move simultaneously. In other words, the first swing portion 152 and the corresponding second swing portion 162 move forward/rearward together. Furthermore, each supporting element 170L/170R includes a supporting portion 171 for supporting the user. The supporting portion 171 is capable of moving along a reciprocating path such as an arc path or a circular path defined by the respective motions of the first swing element 150L/150R and the corresponding second swing element 160L/160R. From the side view, the supporting portions 171 are formed at the rear end of the supporting elements 170L/170R and the first swing portions 152 are pivotally connected to the centers (not shown) of the supporting portions 171 so that when the supporting elements 170L/170R move, the centers of the supporting portions 171 also move along the reciprocating path T1 accordingly.

As shown in FIG. 3, an extension portion 115 is extending from the upper portion of the front portion 112, and a rotating mechanism 180 is set thereon. The rotating mechanism 180 includes one rotating axle or rotating axis 181, one left crank 182L, and one right crank 182*k*. The rotating axle 181 extends transversely (from left to right) relative to the frame 110. Left and right cranks 182L/182R are pivotally connected to the extension portion 115 at a rotating center O around the rotating axle 181, Besides, the cranks 182L/182R are fixedly positioned 180 degrees away from each other corresponding to the rotating center O.

One left connecting member 190L and one right connecting member 190R are respectively connected between the rotating mechanisms 180 and the first swing elements 150L/150R. In the embodiment, each front end of the connecting members 190L/190R is pivotally connected to one distal end of the corresponding crank 182L/182R to move about the rotating center O (rotating axle 181), and each rear end of the connecting members 190L/190R is pivotally connected to the linkage portion 153 of the corresponding first swing element 150L/150R. Therefore, each first swing element 150L/150R and the corresponding crank 182L/182R move simultaneously. Based on the linkage relationship, when one of the first swing elements 150L/150R swings forward, the other one of the first swing elements 150L/150R swings rearward.

In addition, in the rotating mechanism 180, because the cranks 182L/182R rotate 360 degrees around the rotating axle 181, each distal end of the cranks 182L/182R rotate along the whole circular path T4. When each distal end of the cranks 182L/182R rotates entirely around the circular path T4, the corresponding supporting portion 171 moves once back and forth between a front end E1 and a rear end E2 of the reciprocating path (first arc path) T1. As shown in FIG. 4, supporting portions 171 are able to be brought to a position where the two supporting portions 171 align with one another. This is the rest position in the reciprocating path T1, as seen in the side view. When one supporting portion 171 moves forward from the rest position along the reciprocating path T1, the other supporting portion 171 moves rearward from the rest position along the reciprocating path T1. The rest position is not limited to be located right at the middle point of the reciprocating path T1. When one supporting portion 171 is at one end of the reciprocating path T1, the other supporting portion needs not to be at the other end of the reciprocating path T1.

In another embodiment, the rotatable range of the cranks 182L/182R and the swingable range of the first swing elements 150L/150R are further limited by a predetermined stop structure (not shown) so that the distal end of each of the cranks 182L/182R don't rotate entirely around the circular path T4, and the corresponding connecting portion 171 moves along a smaller reciprocating path. In still another embodiment, the cranks 182L/182R are not fixedly positioned 180 degrees away from each other, but the angle between the cranks 182L/182R corresponding to the rotating center O (rotating axle 181) is still fixed. In this embodiment, when one supporting portion 171 moves forward from a rest position along a reciprocating path, the other supporting portion 171 still moves rearward from the rest position along the reciprocating path.

Figure 4A:
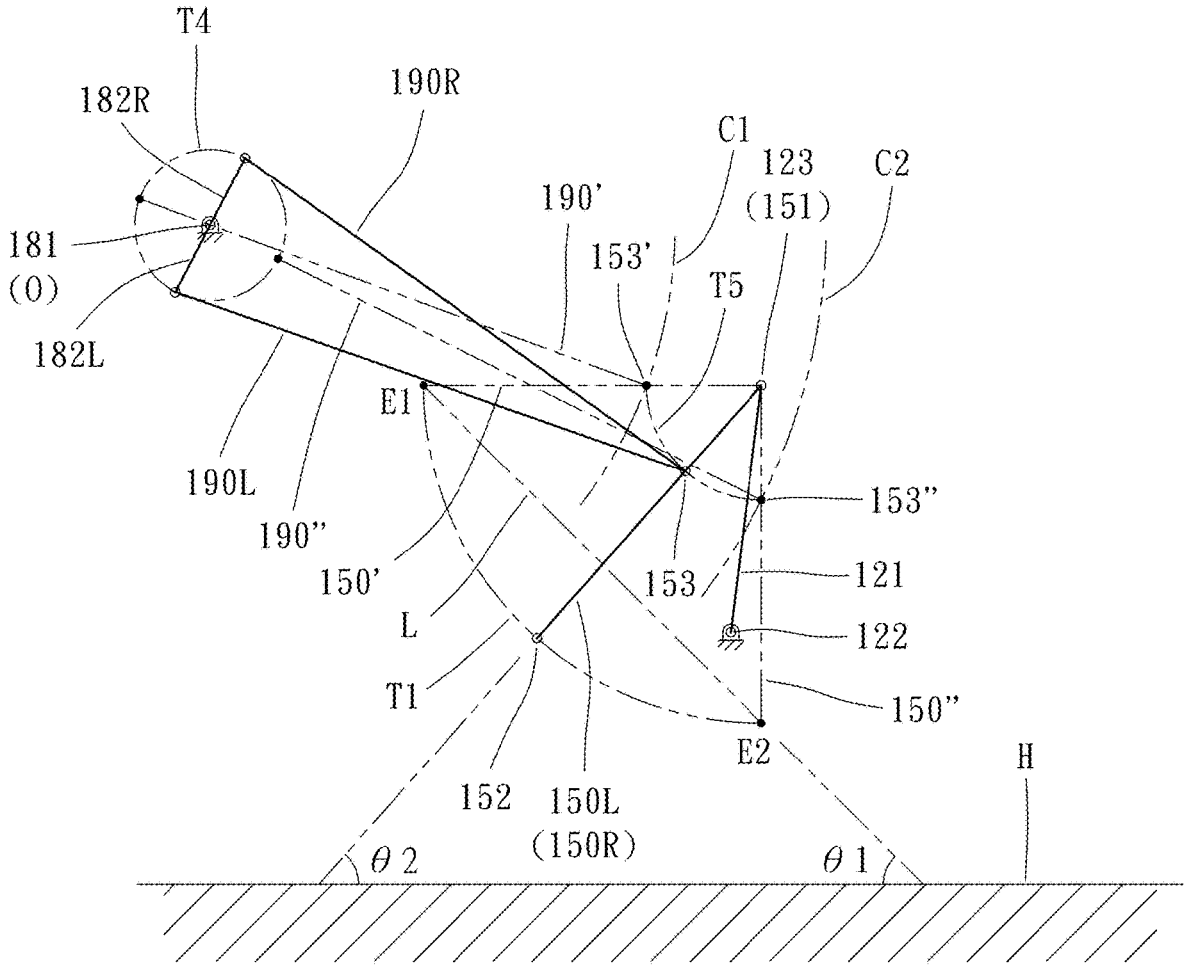

FIG. 4A shows the corresponding path information and geometry parameters of the first swing elements 150L/150R, the rotating mechanism 180, and the connecting members 190L/190R of the stationary exercise apparatus 100 as shown in FIG. 4. In this figure, an internal limitation curve C1 and an external limitation curve C2 are disclosed. C1 and C2 have the same curve center which is the rotating center O (rotating axle 181), the radius of C1 is the difference of the length of one connecting member 190L/190R and the radius of T4, and the radius of C2 is the sum of the length of one connecting member 190L/190R and the radius of T4. According to geometrical principle, when the first swing elements 150L/150R swing, the linkage portions 153 pivotally connected thereon could only move along a fifth arc path T5 between C1 and C2, and therefore the nearest position the linkage portions 153 could achieve toward the rotating center O (rotating axle 181) is a cross point (internal limitation point) 153' and the farthest position the linkage portion 153 could achieve toward the rotating center O (rotating axle 181) is a cross point (external limitation point) 153". As shown by an imaginary connecting member lines 190' and 190", when the linkage portion 153 is at the internal limitation point 153', one end of the imaginary connecting member line 190', the rotating center O (rotating axle 181), and the other end of imaginary connecting member line 190' constitute a straight line. Similarly, when the linkage portion 153 is at the external limitation point 153", one end of imaginary supporting member line 190", the rotating center O (rotating axle 181), and the other end of imaginary connecting member line 190" constitute a straight line. Moreover, as shown by the imaginary swing element line 150', when the linkage portion 153 is at the internal limitation point 153', the bottom end of the imaginary swing element line 150' is at the front end E1; as shown by the imaginary swing element line 150", when the linkage portion 153 is at the external limitation point 153", the bottom end of the imaginary swing element line 150" is at the rear end E2.

When the supporting elements 120 (deflecting poles 121) are located at the first position as shown in FIG. 4A, the front end E1 and the rear end E2 of the reciprocating path (first arc path) T1 of the first swing portions 152 are respectively positioned forward of and right below the first pivot portion 151 as seen from the side view. An elevation angle θ1 defined as an included angle between the horizontal plane H and the line extending from the front end E1 to the rear end E2 is about 45 degrees. A first rest angle θ2 defined as an included angle between the horizontal plane H and the line extending from the first pivot portion 151 toward the first swing portion 152 at the rest position is about 48 degrees from the side view.

Figure 5A:
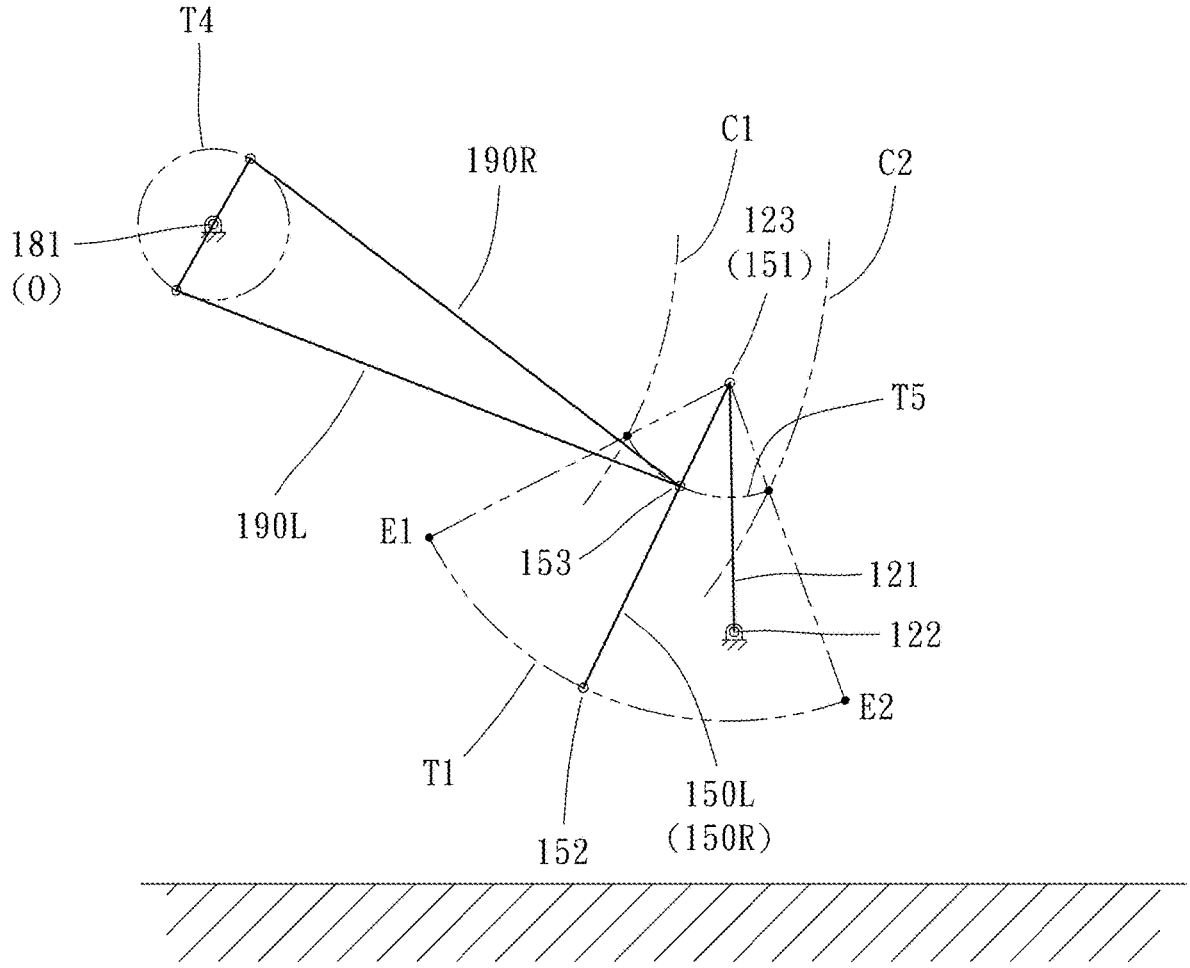
Figure 6A:
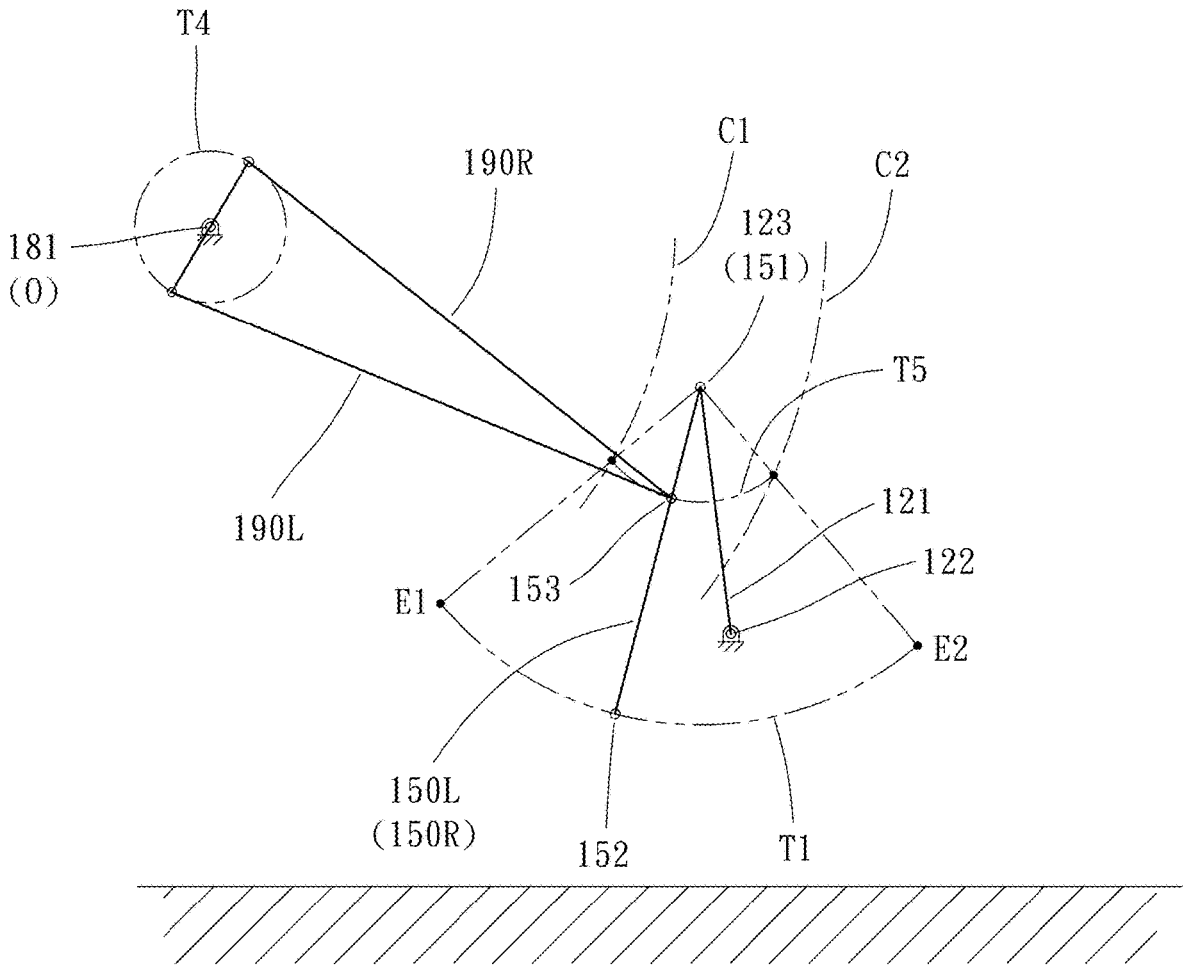

Now referring to FIGS. 5A and 6A, FIGS. 5A and 6A show the corresponding path information and geometry parameters of the first swing elements 150L/150R, the rotating mechanism 180, and the connecting members 190L/190R of the stationary exercise apparatus 100 as shown in FIGS. 5 and 6. The definitions of C1 (internal limitation curve), C2 (external limitation curve), T5 (fifth arc path), and T1 (first arc path) are the same as aforementioned. When the position the supporting member 120 relative to the frame 110 is changed, the position of the first pivot portion 151 relative to the rotating center O (rotating axle 181) is changed, and the positions the fifth arc path T5 and the first arc path T1 relative to the frame 110 are also changed accordingly. Specifically, when the position of the supporting member 120 is changed from the first position as shown in FIGS. 4 and 4A to the second position as shown in FIGS. 5 and 5A, the front end E1 of the first arc path T1 becomes lower and the rear end of the first arc path T1 move rearward. The elevation angle θ1 here is about 21 degrees and the first rest angle θ2 here is about 64 degrees; when the position of the supporting member 120 is changed from the second position to the third position as shown in FIGS. 6 and 6A, the front end E1 of the first arc path T1 moves lower yet and the rear end of the first arc path T1 moves even more rearward. The elevation angle θ1 here is about 5 degrees and the first rest angle θ2 here is about 75 degrees.

Figure 4B:
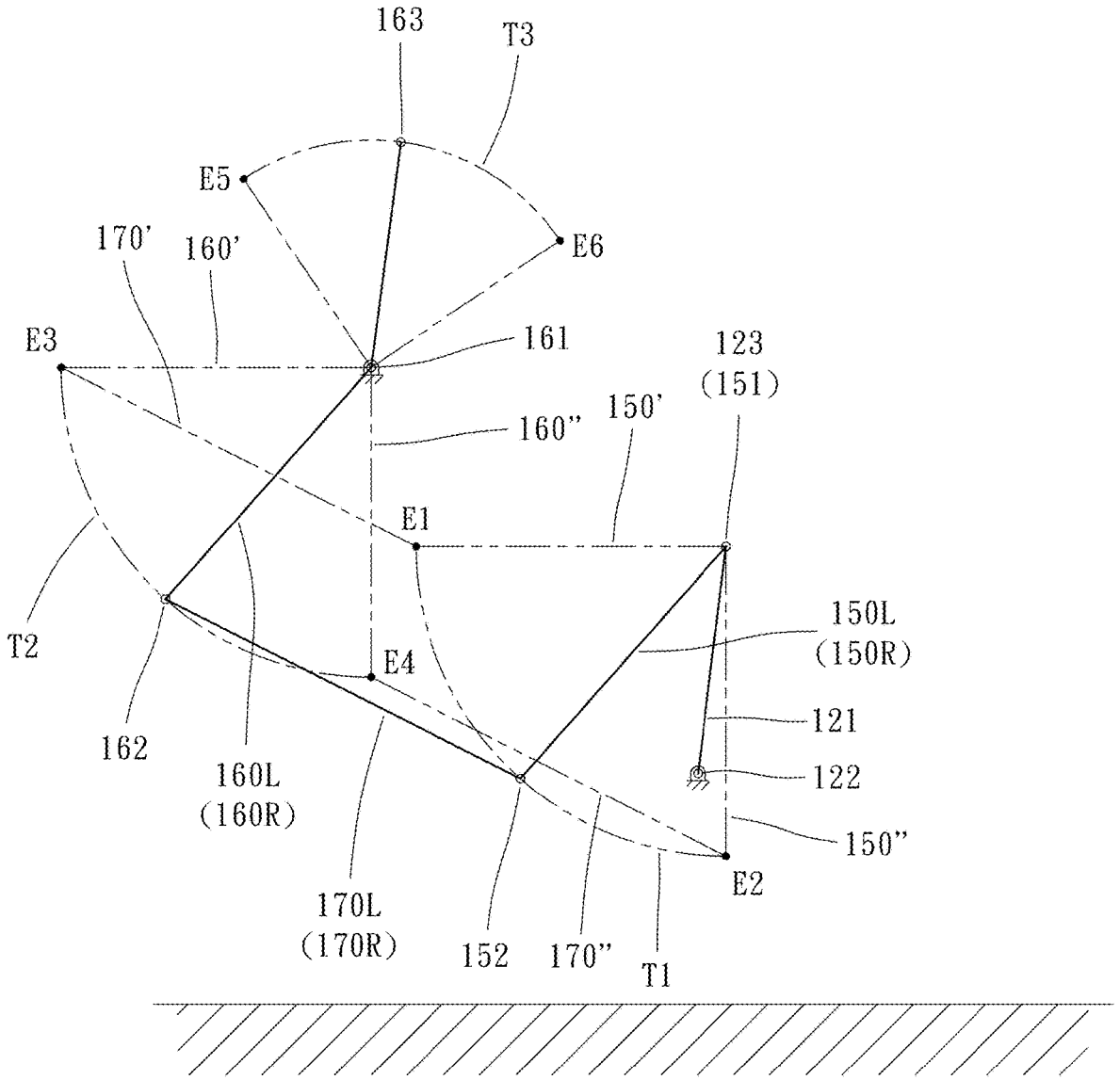

FIGS. 4B-6B show the corresponding path information and geometry parameters of the first swing elements 150L/150R, the second swing elements 160L/160R, and the supporting elements 170L/170R of the stationary exercise apparatus 100 shown in FIGS. 4-6 and 4A-6A. In FIG. 4B, for example, when the first swing elements 150L/150R rotate clockwise (toward the front of the stationary exercise apparatus 100) to an extreme position as shown by the imaginary swing element line 150', the corresponding second swing elements 160L/160R and the corresponding supporting elements 170L/170R also rotate clockwise (forward) to the corresponding positions as shown by the imaginary lines 160' and 170'. When the first swing elements 150L/150R rotate counterclockwise (rearward) to another extreme position as shown by the imaginary swing element line 150", the corresponding second swing elements 160L/160R and the corresponding supporting members elements 170L/170R also rotate counterclockwise (rearward) to the corresponding positions as shown by the imaginary lines 160" and 170". When the first swing portion 152 moves through one cycle (back and forth between the front end E1 and the rear end E2 of the first arc path T1), the second swing portion 162 moves through one cycle (back and forth between a third end E3 and a fourth end E4 of the second arc path T2), and the grip portion 163 moves through one cycle back and forth between a sixth end E6 and a fifth end E5 of the second arc path T3.

Figure 5B:
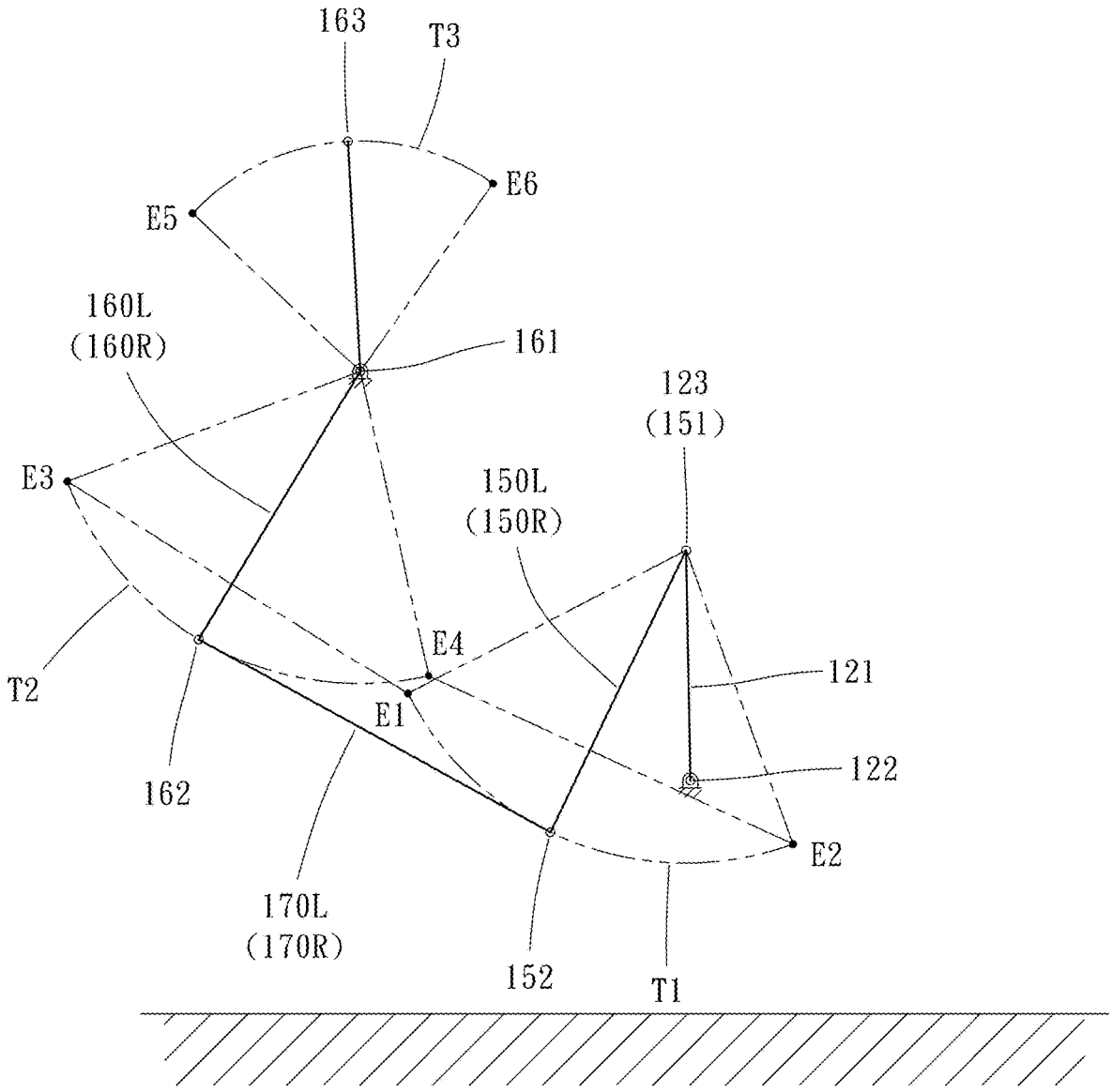
Figure 6B:
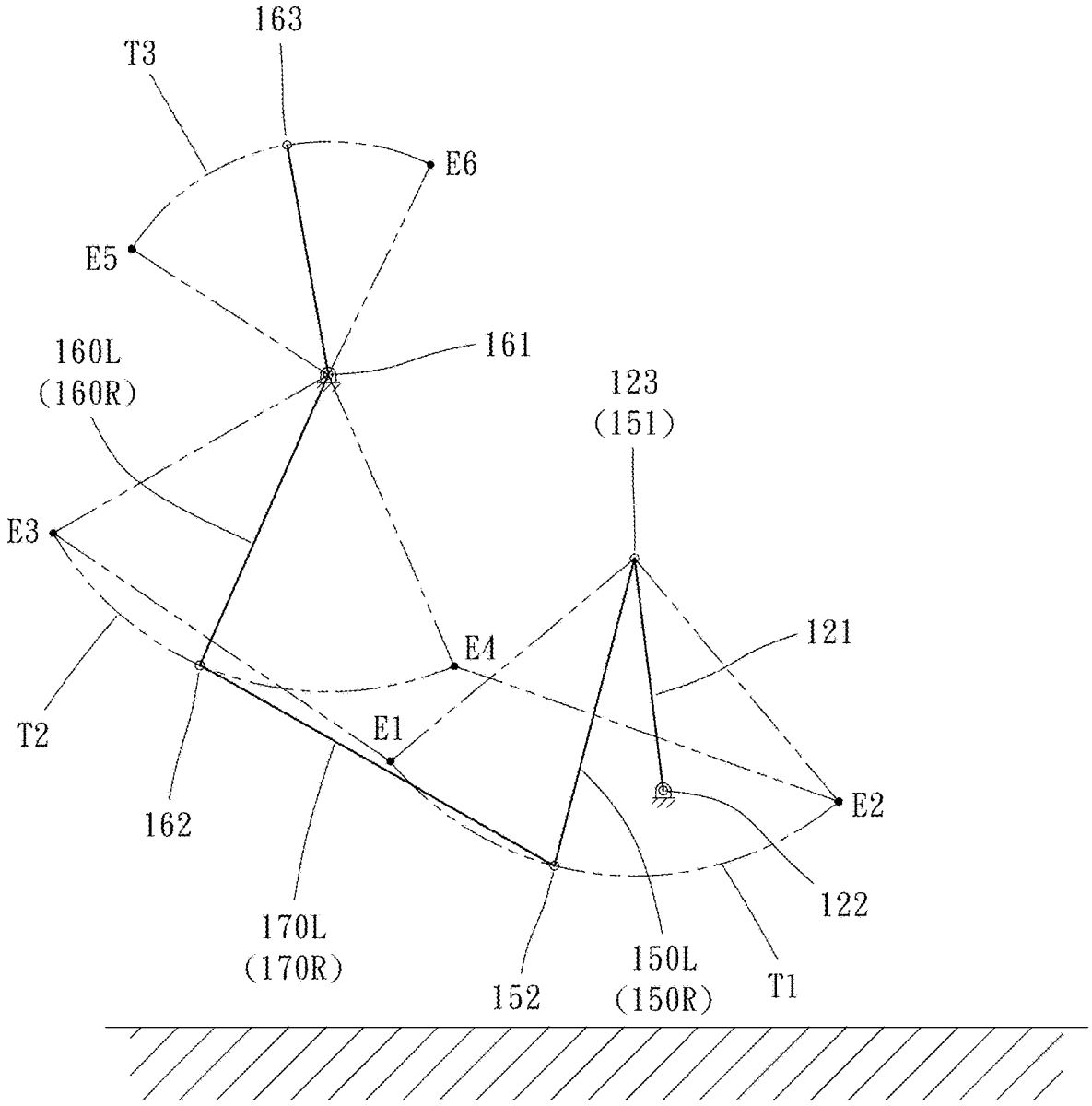

Comparing FIGS. 4B, 5B, and 6B, when the first pivot portion 151 moves forward/rearward relative to the frame 110, the rear end E2 of the first arc path T1 and the rear end E4 of second arc path T2 move rearward/forward simultaneously, and the front end E5 of the third path T3 moves forward/rearward simultaneously. In other words, by adjusting the first arc path T1, the third arc path T3 is changed, and the largest distance between the first arc path T1 and the third arc path T3 is also changed.

Based on the structures and the principle aforementioned, the user can change the moving path of the supporting portions 171 by adjusting the position the supporting member 120 relative to the frame 110, and exercise with different postures and motions is possible: For example, when the supporting member 120 is located at the first position as shown in FIG. 4, the front end E1 of the reciprocating path T1 is forward of the first pivot portion 151, and the rear end E2 of the reciprocating path T1 is below the first pivot portion 151. The rest position of the supporting portions 171 has approximately a 45-degrees rest angle; while exercising, the user is capable of choosing to grip the grip set 114 or the grip portions 163 to let arms exercise along with the legs. The user exercises alternately with one leg lifting and the other leg pressing onto one of the supporting portions 171 and the exercising path range can be adjusted by self-controlling the movement of the feet by the user. When the supporting members 120 are located at the second position as shown in FIG. 5 and at the third position as shown in FIG. 6, the arc angles of the arcs of the reciprocating paths T1 are also about 90 degrees, but the front ends E1 move lower and the rear ends E2 move more rearward, and the user therefore exercises with different postures and motions along different reciprocating paths T1. Three predetermined positions for the supporting member 120 are shown in this embodiment. However, the number the predetermined positions the supporting members 120 can be located at is not limited, and two or more is in the spirit of the present disclosure.

In addition to adjusting the moving path of the user's feet, comparing to the conventional exercise apparatus, the supporting portions 171 for supporting the user have specific orientation angles and don't rotate arbitrarily to different positions at every point of the exercising path. Therefore, the user has more safety, stability, and convenience during exercise, especially while stepping on and off the stationary exercise apparatus. In one preferred embodiment, the supporting portions 171 keep their upper surfaces horizontal relative to the ground at any point of the reciprocating path T1. However, the specific orientation angle of the supporting portions 171 is not limited thereto, and the specific orientation angles are able to be modified by changing the geometry of any of a number of the components in the stationary exercise apparatus 100.

While the user is exercising their legs, the user is also capable of gripping the grip portions 163 of the second swing elements 160L/160R and doing arms exercise alternately with one arm pushing and one arm pulling so that the goal of full body exercise can be achieved. In one preferred embodiment, the leg and the arm exercise in the reverse directions. For example, when one leg is moving forward/rearward, the corresponding arm at the same side is moving rearward/forward simultaneously. Meanwhile, comparing FIGS. 4-6, when the rear end E2 is changed to move rearward, the front end E5 of the third arc path T3 is changed to move forward, and the distance between the first arc path T1 and the third arc path T3 is increased.

According to the previous embodiments, the user is capable of entering and leaving the stationary exercise apparatus 100 from the rear side of the frame 110, exercising in the exercise space located between the left side portion 113L and the right side portion 113R of the frame 110. This exercise space is also located between the left first swing element 150L and the left connecting member 190L and the right first swing element 150R and the right connecting member 190R.

The stationary exercise apparatus of the present disclosure can further includes one resistance member (not shown) which is used to produce resistance for the first swing elements, the second swing elements, and the supporting elements and so on so that the exercise intensity of the stationary exercise apparatus can be adjusted. For example, a magnetic resistance assembly may be set at the bottom portion(s) of the first swing elements 150L/150R and/or the second swing elements 160L/160R, and a metal plate may be placed in the area of the first arc path T1 and/or the second arc path T2. With this configuration, to swing the first swing elements 150L/150R and the second swing elements 160L/160R, the user needs to overcome the resistance of the eddy current raised between the magnetic resistance assembly and the metal plate. Furthermore, the magnitude of the resistance force can be adjusted by changing the distance and/or the overlapping area between the magnetic resistance assembly and the metal plate. In another embodiment, the resistance can also be produced by connecting a gas spring between each first swing element 150L/150R and the corresponding deflecting pole 121, connecting a gas spring between each second swing element 160L/160R and the frame 110, and/or by using a friction assembly or a magnetic resistance assembly in conjunction with the rotating mechanism 180.

In the aforementioned stationary exercise apparatus 100, the left first swing element 150L, the left second swing element 160L, and the left supporting element 170L constitute a left moving assembly 140L, and the right first swing element 150R, the right second swing element 160R, and the right supporting element 170R constitute a right moving assembly 140R. Moreover, the rotating mechanism 180 and the connecting members 190L/190R constitute a linkage arrangement. In other words, the linkage arrangement is arranged between the left moving assembly 140L and the right moving assembly 140R so that the movement of the left moving assembly 140L and the right moving assembly 140R are correlated and simultaneous; the supporting portions 171 of the supporting elements 170L/170R come to a rest at a rest position in the reciprocating path T1 where the supporting elements 170L/170R are aligned with one another. When one supporting portion 171 is moving from the rest position toward the front end E1 along the first arc path T1, the other supporting portion 171 is moving from the rest position toward the rear end E2 along the first arc path T1 simultaneously.

In another embodiment, the linkage arrangement can be directly connected to the second swing elements. For example, a stationary exercise apparatus has all the elements the same as those shown in FIG. 3 except the second ends of the connecting members 190L/190R are respectively connected to the corresponding second swing elements 160L/160R. In this embodiment, similar to the previous embodiments, the movement of the left moving assembly 140L and the right moving assembly 140R are still correlated and simultaneous. Additionally, when the left supporting element 170L is moving forward from the rest position, the right supporting element 170R is moving rearward from the rest position. Because the relative position between the second pivot 161 and the rotating center O (rotating axle 181) is fixed, the swingable range of the second swing elements 160L/160R remains the same. In other words, the second arc path T2 and the third arc path T3 are fixed even when the position supporting members 120 relative to the frame 110 is changed according to FIGS. 4-6, 4A-6A, and 4B-6B. Furthermore, because one end of each supporting portion 171 is connected to the corresponding first swing element 150L/150R, the first arc path T1 still changes corresponding to the moving of the supporting members 120.

The structure of the linkage arrangement is not limited to the embodiments mentioned herein. Another possible structure includes using a circular rotatable structure set on the frame in place of the rotating axle and the cranks and connecting the front ends of the connecting members to positions on the circular rotatable structure with a predetermined angle corresponding to the center of the rotatable structure. Another possible structure involves setting a gear (ellipsoid gear) coaxially with the second pivot of the second swing elements with the gears further synchronously driven by a transmission gear so that the second swing elements swing in reverse directions with the same speed. Yet another possible structure involves setting a pulley (sprocket wheel) coaxially with the second pivot of each second swing element and connecting the pulleys (sprockets) by a loop belt (chain) so that the second swing elements swing in reverse directions with the same speed.

Figure 7:
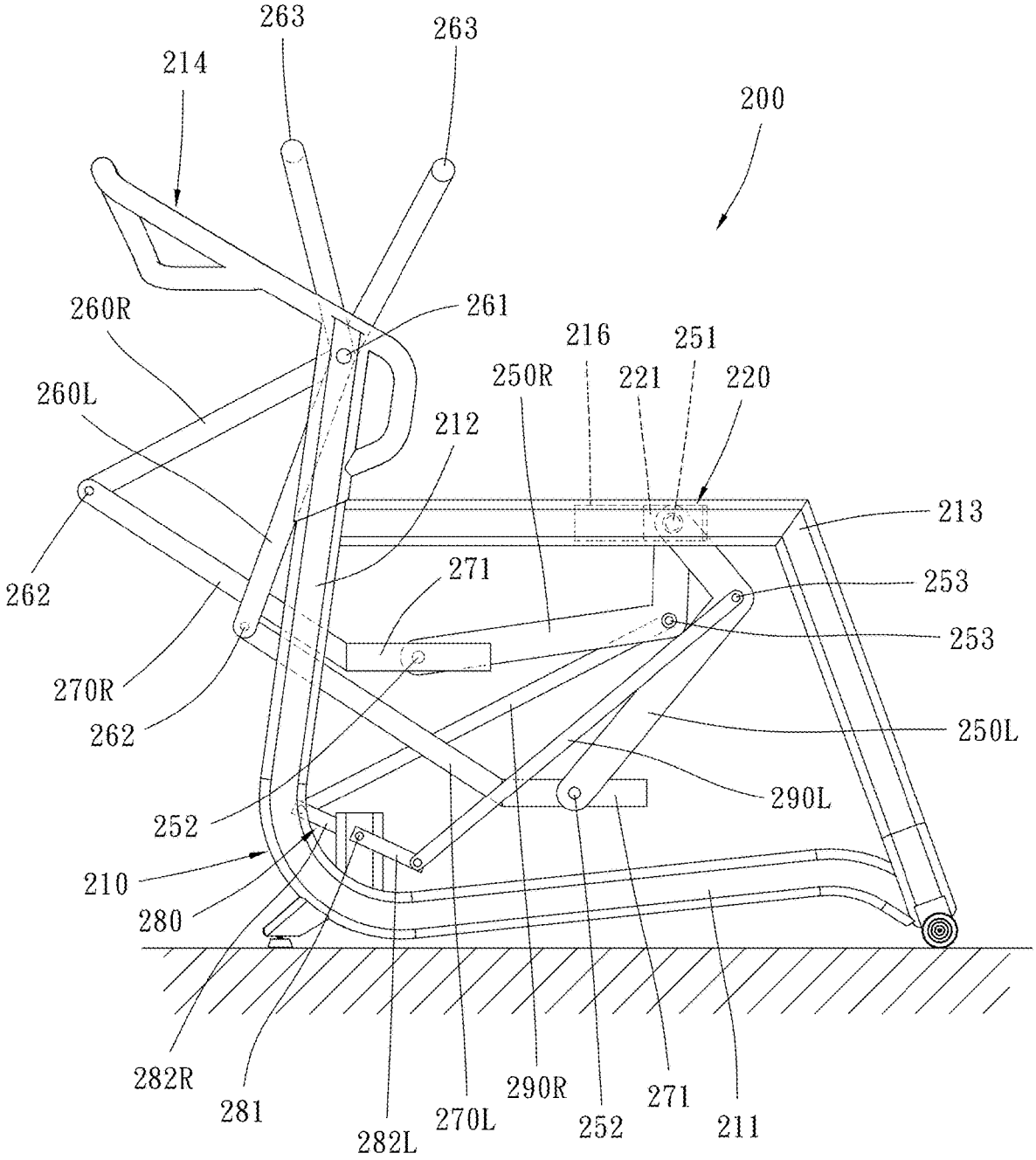
FIG. 7 is a side view of a stationary exercise apparatus in a first position in accordance with the second embodiment of the present disclosure and with the supporting portions shown not aligned.

FIG. 7 is a side view of a stationary exercise apparatus 200 according to the second embodiment of the present disclosure. In FIG. 7, the stationary exercise apparatus 200 has a frame 210 generally including a base 211, a front portion 212, and a side portion 213. Furthermore, the top end of the front portion 212 includes a grip set 214 for the user to grip. Besides, while exercising, the user is capable of choosing to grip the grip set 214 or the grip portions 263 which are pivotally connected to the upper portion of the front portion 212 in order to let the arms exercise along with the legs.

The stationary exercise apparatus 200 further includes a supporting member 220 whose position relative to the frame 210 is adjustable; a left first swing element 250L and a right first swing element 250R pivotally connected to the supporting member 220; a left second swing element 260L and a right second swing element 260R pivotally connected to the frame 210; a left supporting element 270L and a right supporting element 270R respectively connecting to the corresponding first swing elements 250L/250R and corresponding second swing elements 260L/260R; a rotating mechanism 280 rotatable set on the frame; and a left connecting member 290L and a right connecting member 290R respectively connected to the rotating mechanism 280 and the corresponding first swing elements 250L/250R.

Figure 8:
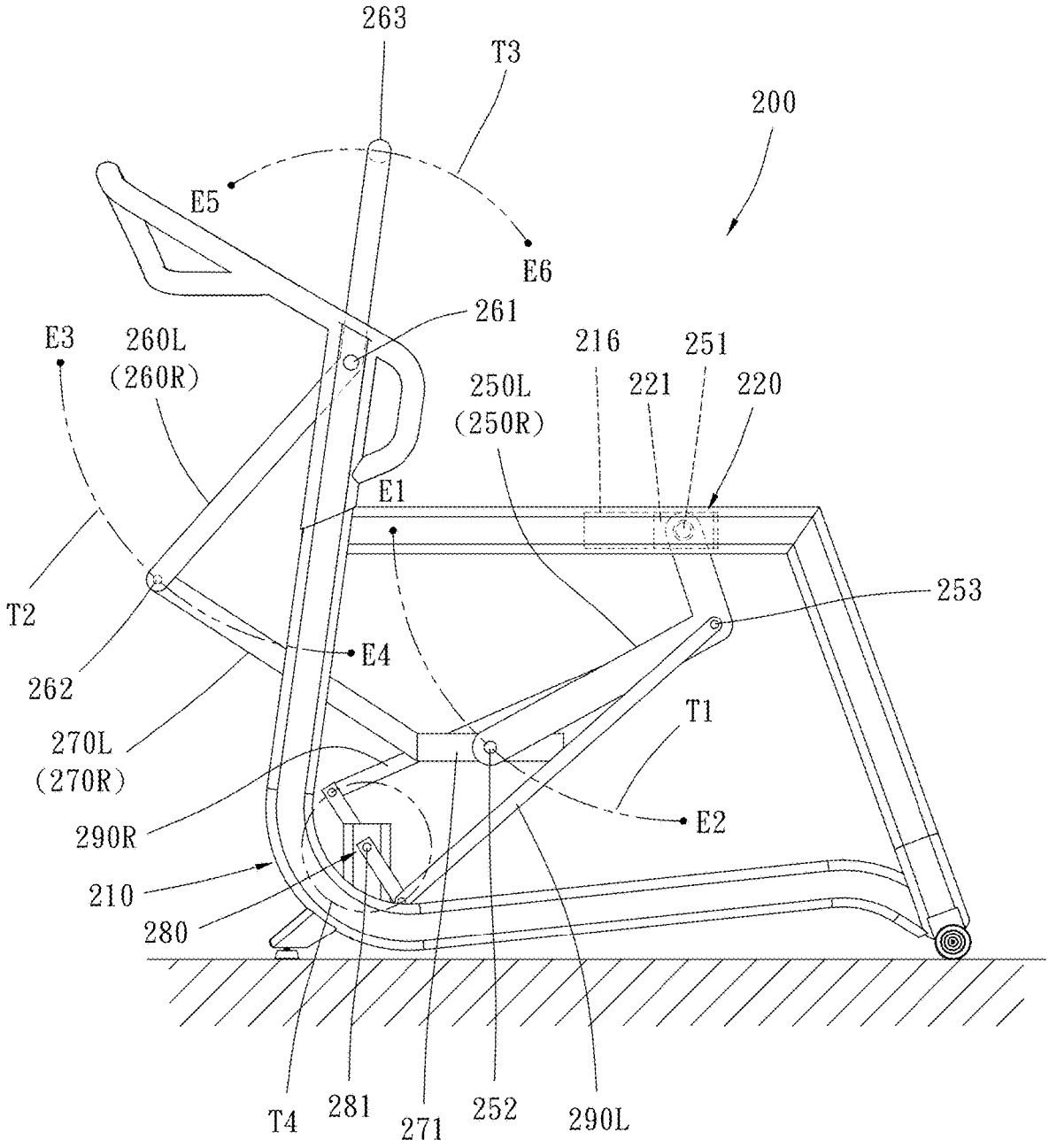
FIG. 8 is a side view of a stationary exercise apparatus in FIG. 7 and with the supporting portions shown aligned with each other.
Figure 8A:
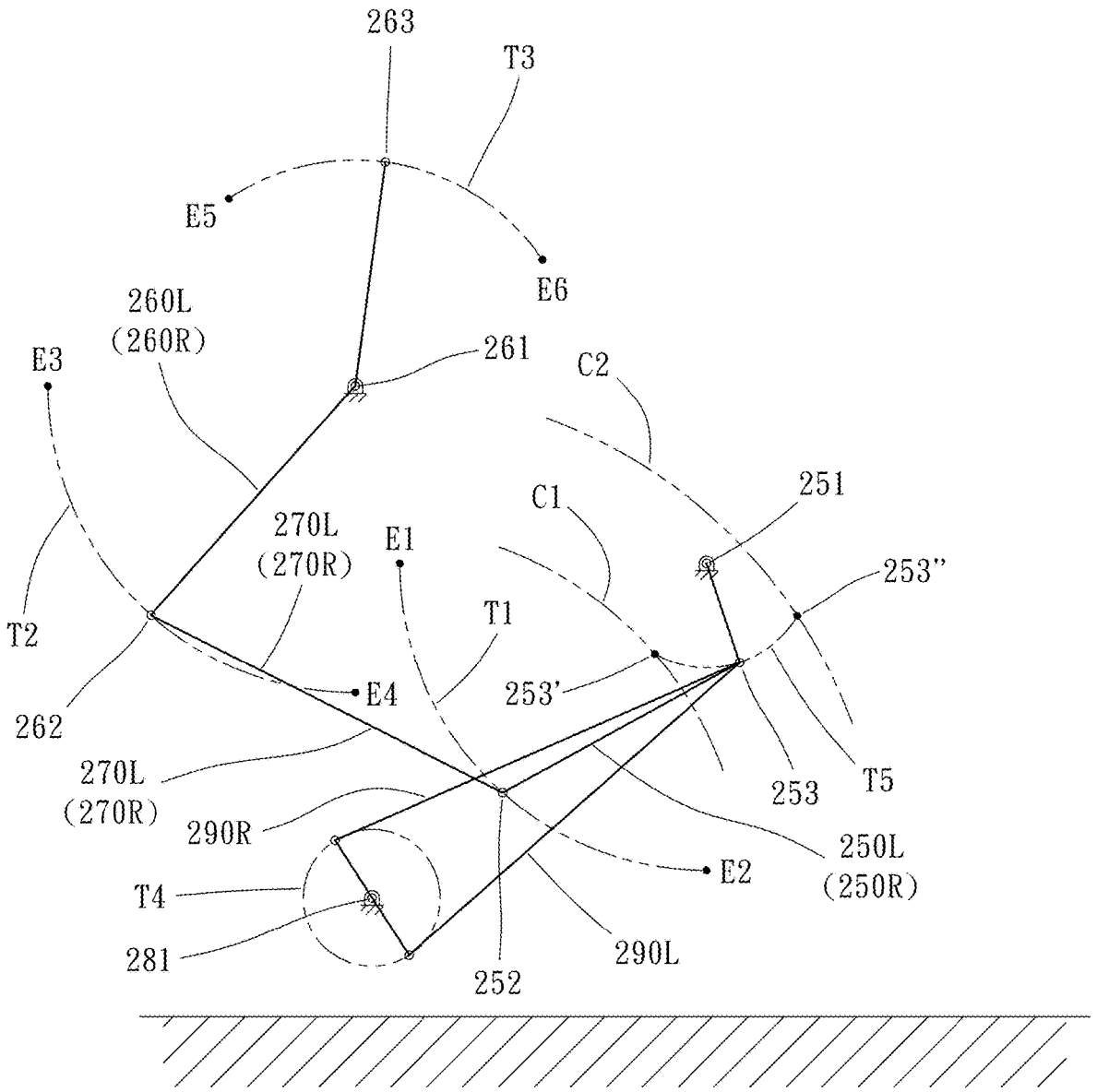
Figure 9:
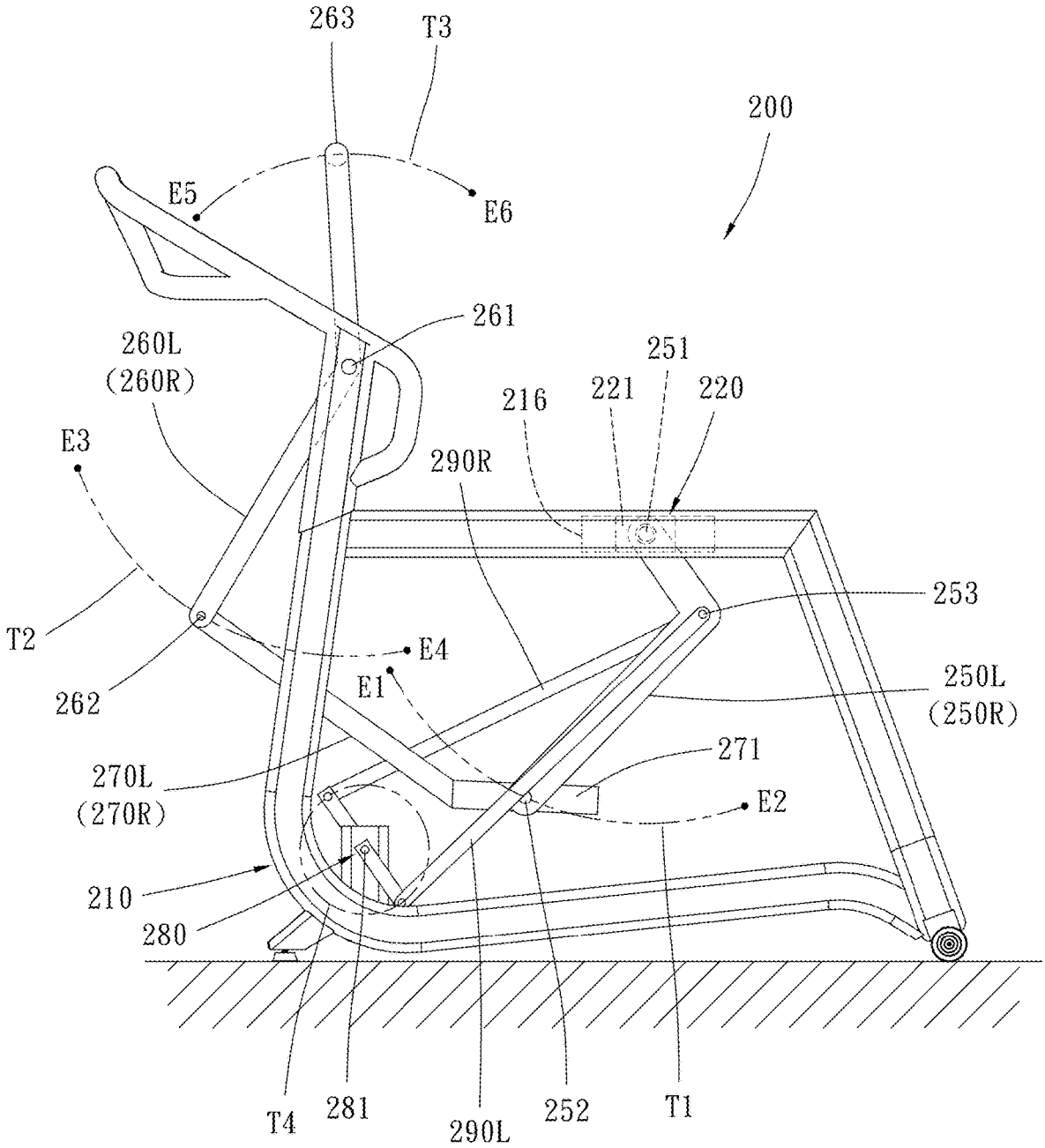
FIG. 9 is a side view of a stationary exercise apparatus in a second position in accordance with the second embodiment of the present disclosure.
Figure 9A:
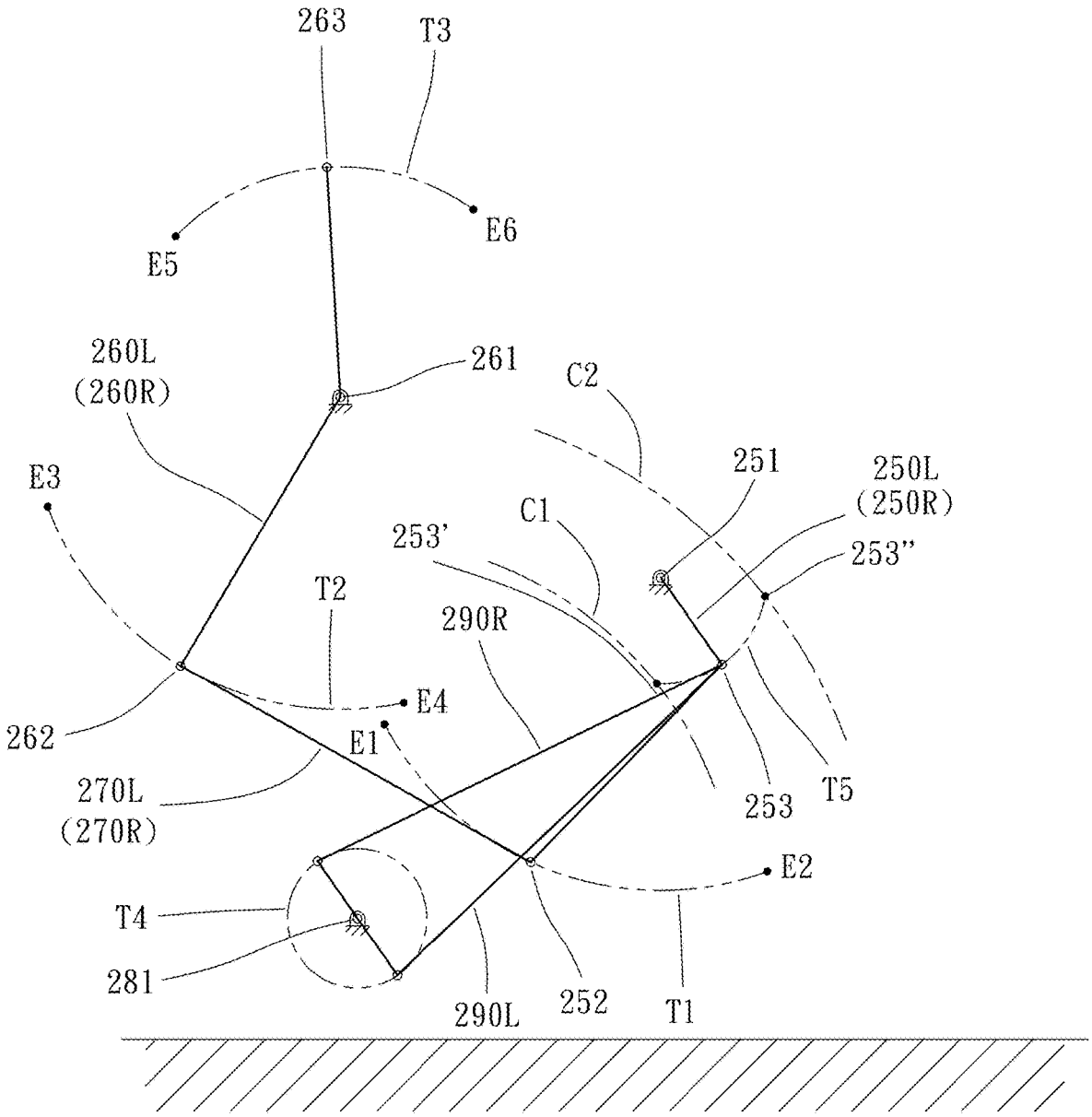
Figure 10:
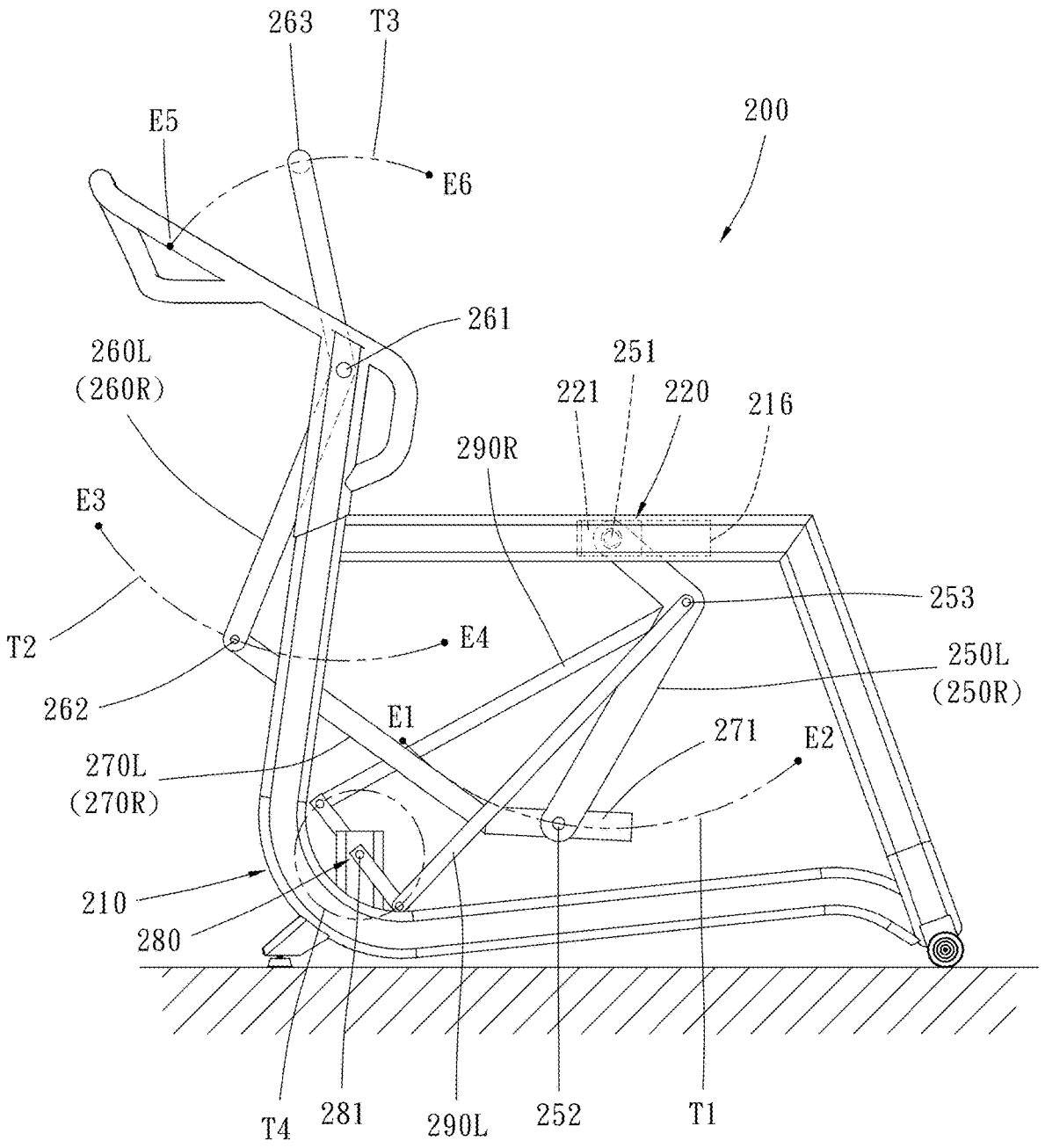
FIG. 10 is a side view of a stationary exercise apparatus in a third position in accordance with the second embodiment of the present disclosure.
Figure 10A:
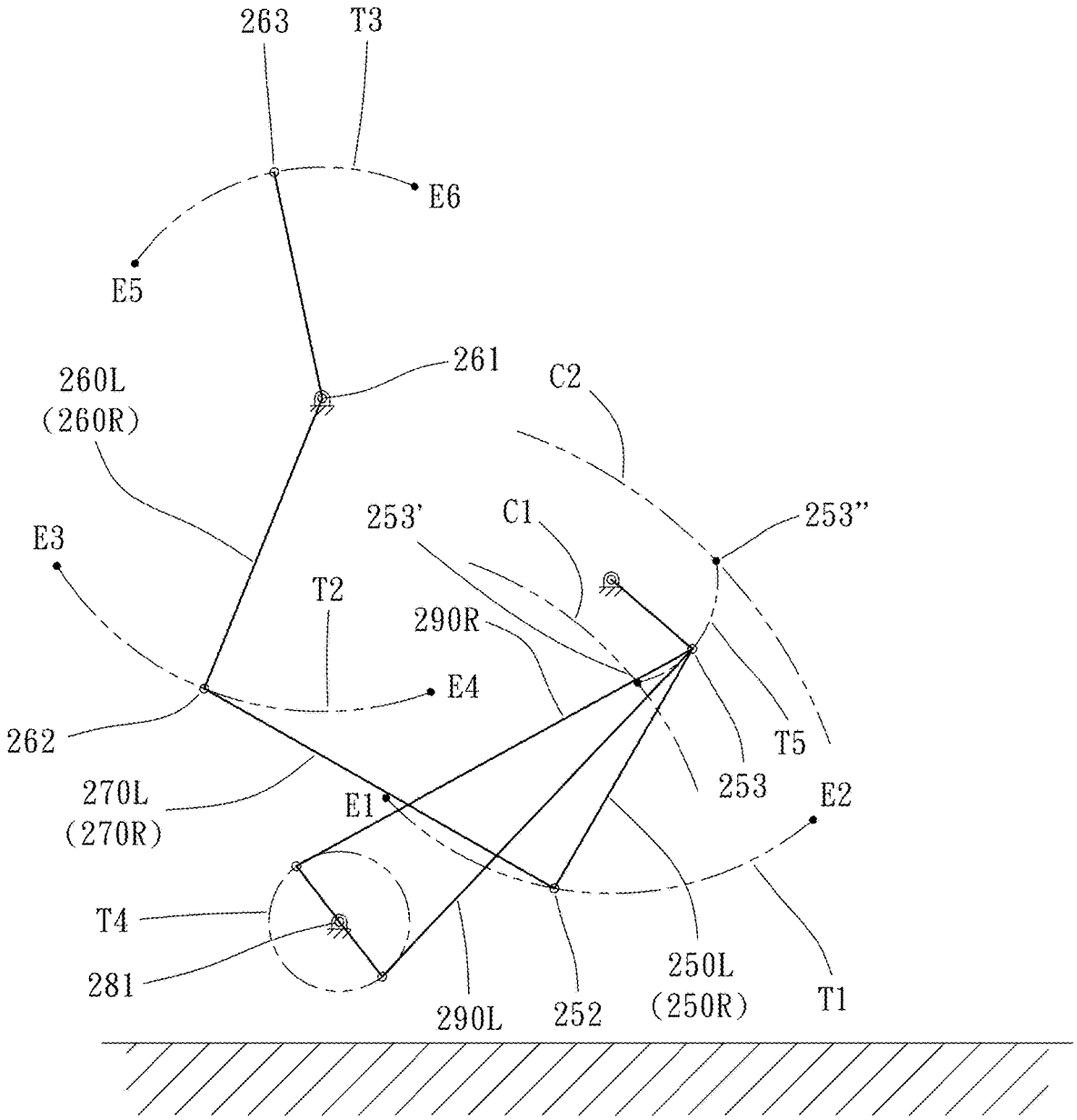

The largest difference between the first embodiment and the second embodiment is the structure of the supporting member 220. The supporting member 220 includes a left supporting structure and a right supporting structure 221 (Supporting structures 221 are shown aligned with one another, and because of this, the right supporting structure 221 is omitted from the side view). Each supporting structure 221 is set on the frame 210 and the position thereof relative to the frame 210 can be adjusted by moving the supporting structure 221 along a guide slot 216 fore and aft. The supporting structures 221 are capable of being adjustably positioned at a first position as shown in FIGS. 7-8, a second position as shown in FIG. 9, and a third position as shown in FIG. 10. The position of the supporting member 220 can be adjusted manually or automatically.

Further referring to FIG. 8, each first swing element 250L/250R is pivotally connected to the corresponding supporting structure 221 with a first pivot 251 at the top portion thereof so that a corresponding first swing portion 252 at the bottom portion thereof is capable of swinging along a first arc path T1. Each second swing element 260L/260R is pivotally connected to the front portion 212 of the frame 210 with a second pivot 261 at the middle portion thereof so that a corresponding second swing portion 262 at the bottom portion thereof is capable of swinging along a second arc path T2. Each connecting element 270L/270R is connected to the corresponding first swing portion 252 and the corresponding second swing portion 262 so that a supporting portion 271 formed at one end thereof is capable of moving along a reciprocating path. In the embodiment, the rotating mechanism 280 is located on at an extension portion of the base 211. The structure of the rotating mechanism 280 in the present disclosure includes a rotating axle 281, a left crank 282L, and a right crank 282R which is similar to the structures in the previous embodiment. Each connecting member 290L/290R is pivotally connected to a corresponding linkage portion 253 at a predetermined portion of the first swing elements 250L/250R. In the embodiment, the first pivot 251, the corresponding first swing element 252, and the corresponding linkage portion 253 are not arranged in a straight line, but the distance between the first pivot 251 and the corresponding linkage portion 253 is still smaller than the distance between the corresponding first swing portion 252 and the corresponding linkage portion 253. In other words, a smaller rotating mechanism 280 and a larger leg exercising path are achieved because the rotating path of the first swing portion 252 is larger than the rotating path of the linkage portion 253.

FIGS. 8A-10A are path information and geometry parameters of the stationary exercise apparatus 200 in accordance with the second embodiment of the present disclosure in FIGS. 8-10. As shown in the figures, when the position the supporting member 220 relative to the frame 210 is changed, the position the first pivot 251 relative to the rotating axle 281 is changed accordingly, and the front end E1 and the rear end E2 of the first arc path T1 and the rest position of the supporting portions 271 from the side view are changed accordingly. The geometrical principle is the same as the description in the previous embodiment and therefore not mentioned again. (The reference numerals 253' and 253" shown in FIGS. 8A-10A have the same meanings as the reference numerals 153' and 153" shown in FIGS. 8A-10A).

Figure 11:
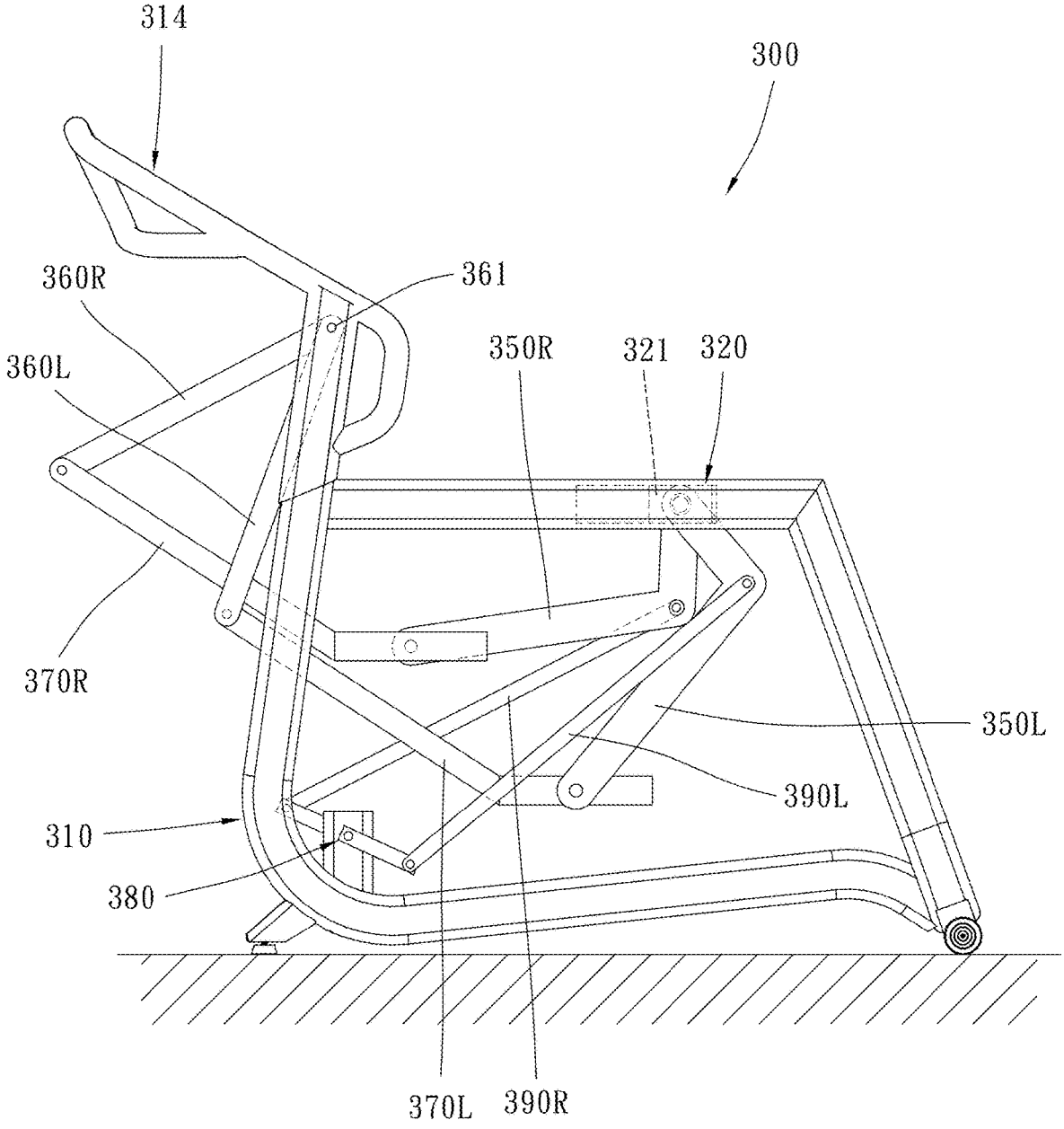
FIG. 11 is a side view of a stationary exercise apparatus in accordance with the third embodiment of the present disclosure and with the supporting portions shown not aligned.

FIG. 11 is a side view of a stationary exercise apparatus 300 according to the third embodiment of the present disclosure. In FIG. 11, the stationary exercise apparatus 300 has all the elements the same as those shown in FIG. 7 except the movable grip portions are omitted. Therefore, while exercising, the user can only grip the fixed grip set 314 and the arms of the user are not exercised corresponding to the legs thereof. Instead, in another embodiment, movable grip portions are capable of being added to the first swing elements which have a rotating axle on the supporting member, thereby creating a situation where the moving path of the grip portions is changed corresponding to the moving of the supporting member. (The reference numerals 310, 320, 321, 350L/350R, 360L/360R, 361, 370L/370R, 380, 390L/390R shown in FIG. 11 have the same meanings as the reference numerals 210, 220, 221, 250L/250R, 260L/260R, 261, 270L/270R, 280, 290L/290R shown in FIG. 7).

Figure 12:
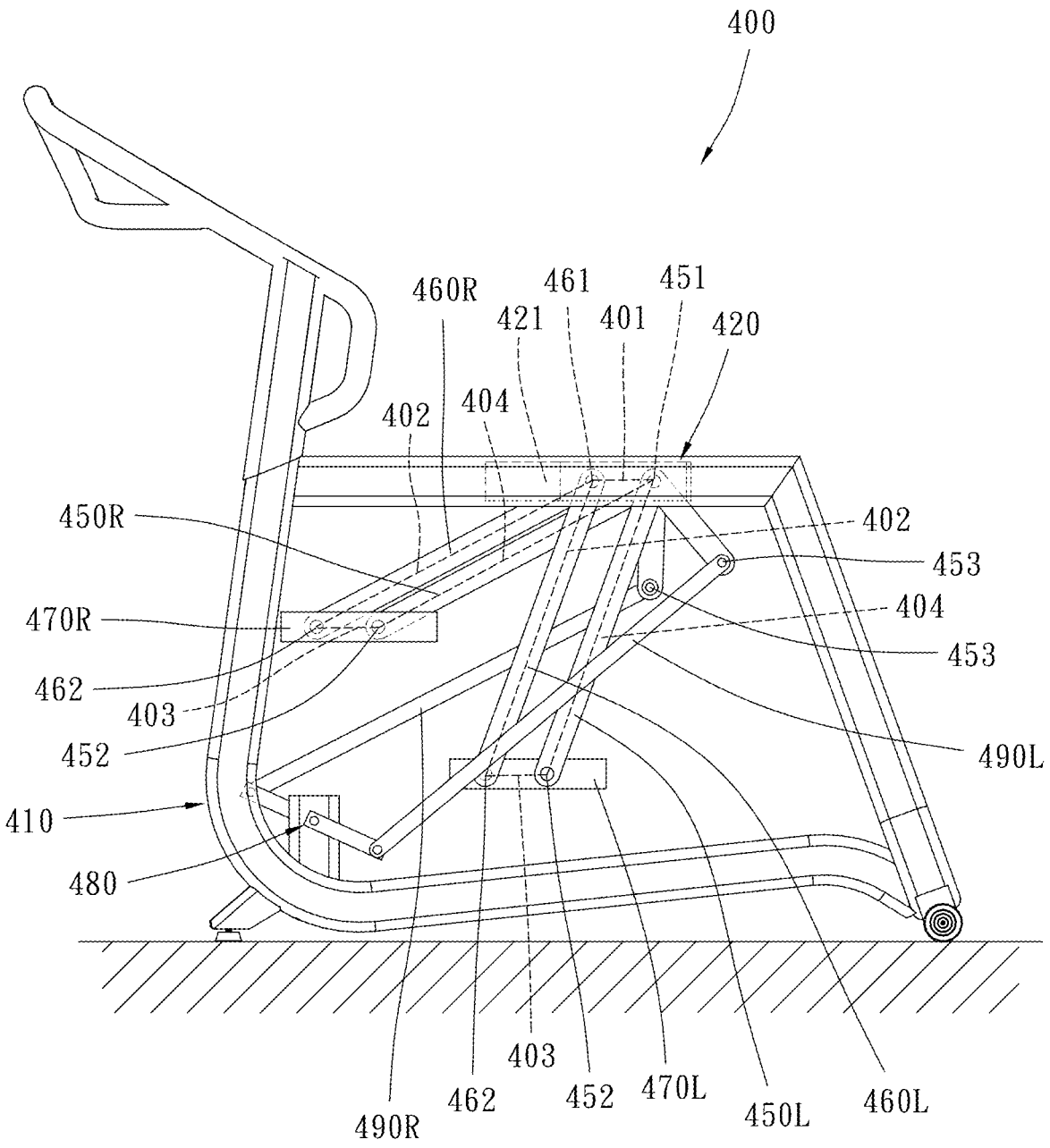
FIG. 12 is a side view of a stationary exercise apparatus in accordance with the fourth embodiment of the present disclosure and with the supporting portions shown not aligned.

FIG. 12 is a side view of a stationary exercise apparatus 400 according to the fourth embodiment of the present disclosure. The largest difference between the present embodiment and the previous embodiments is that the second pivot 461 of a second left swing element 460L and a second right swing element 460R is not directly connected to a frame 410 of the stationary exercise apparatus 400, but is connected to a supporting member 420 of the frame 410. The first pivot 451 of a first left swing element 450L and a first right swing element 450R is also connected to the supporting member 420, and the supporting member 420 is capable of changing its position relative to the frame 410. Each first pivot 451 and each corresponding second pivot 461 are pivotally connected one after the other to a supporting structure 421 and the axes thereof are fixed parallel with each other so that even when the supporting structure 421 moves on the frame 410, the relative distance and the relative angle between the first pivot 451 and the second pivot 461 are fixed.

A left supporting element 470L and a right supporting element 470R are respectively pivotally connected to the corresponding first swing portion 452 and the corresponding second swing portion 462 with a fixed distance between the corresponding first swing portion 452 and the corresponding second swing portion 462. From the side view, a first imaginary line 401 from the first pivot 451 of one side to the second pivot 461 of the same side, a second imaginary line 402 from the second pivot 461 of the same side to the corresponding second swing portion 462, a third imaginary line 403 from the corresponding second swing portion 462 to the corresponding first swing portion 452, and a fourth imaginary line 404 from the corresponding first swing portion 452 to the first pivot 451 of one side constitute a parallelogram. In other words, because the first imaginary line 401 is always parallel with the third imaginary line 403, regardless of the position the supporting elements 470L/470R move to along an arc reciprocating path, the arc reciprocating path is changed by adjusting the position the supporting member 420 relative to the frame 410, and the angle of each supporting element 470L/470R relative to the ground keeps the same. In the embodiment, the top surface of each supporting element 470L/470R keeps horizontal.

In the previous embodiments, the relative distance and the relative angle between the first pivot and the second pivot are also the same but four imaginary lines don't constitute a parallelogram so that the elevation angles are changed while the supporting portions moving along with the reciprocating path. For example, when one supporting portion is moving toward the front end of the reciprocating path, the front end (toe portion) of the supporting portion is raising corresponding to the rear end (heel portion) thereof. Because the included angle between the first imaginary line and the horizontal plane remains the same, the relative angle between the front end and the rear end of the reciprocating path changes, and the supporting portion at the same point of the reciprocating path has the same elevation angle. For example, the top surface of the supporting portion is always horizontal when the first swing portion is right below the first pivot and the second swing portion is right below the second pivot. (The reference numerals 453, 480, 490L/490R shown in FIG. 12 have the same meanings as the reference numerals 253, 280, 290L/290R shown in FIG. 7).

Figure 2:
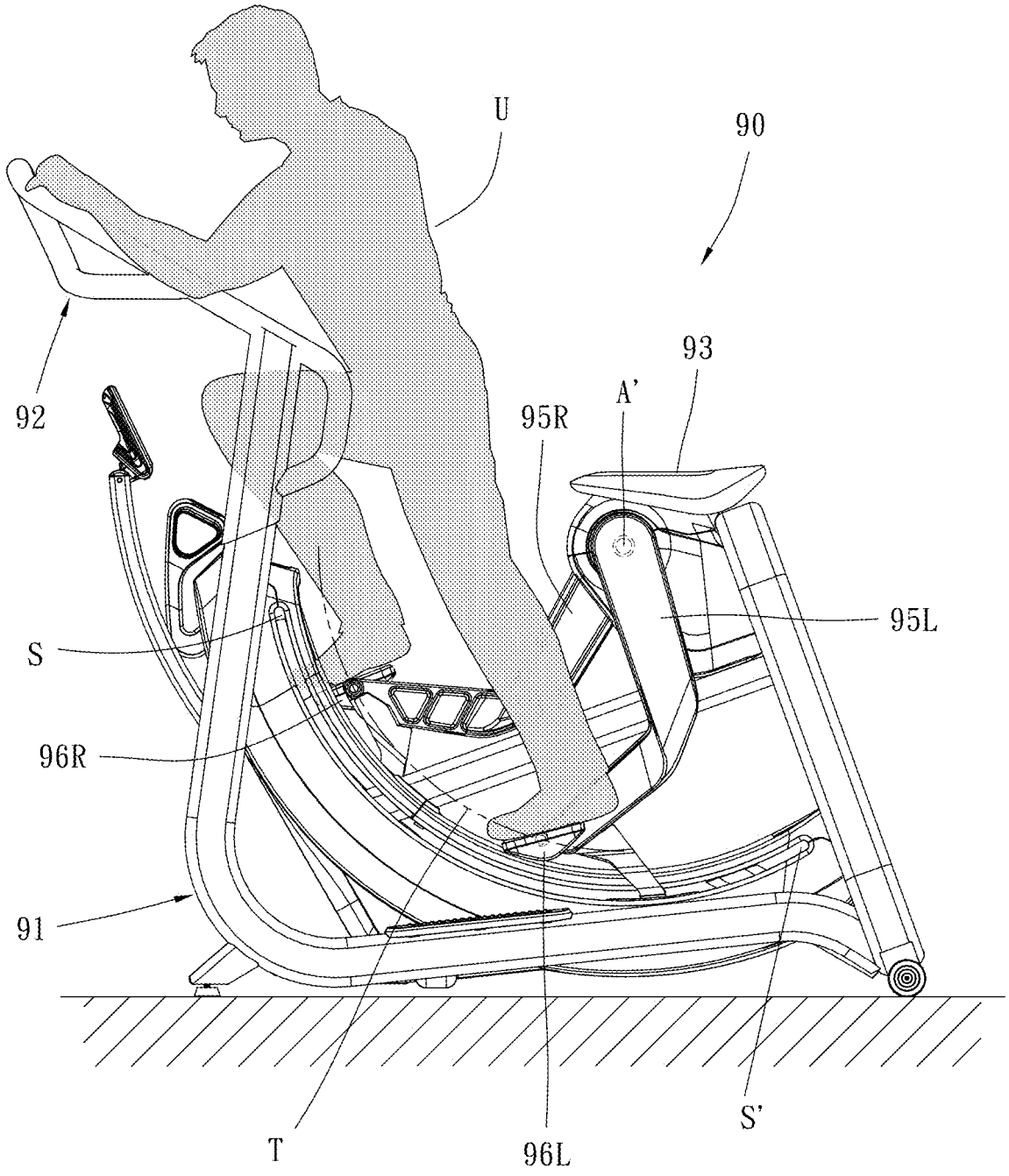
FIG. 2 PRIOR ART
FIG. 2 is a side view of the exercise apparatus of FIG. 1 showing the rotating arms in a position other than their rest position, with the rotating arms shown not aligned.
Figure 13:
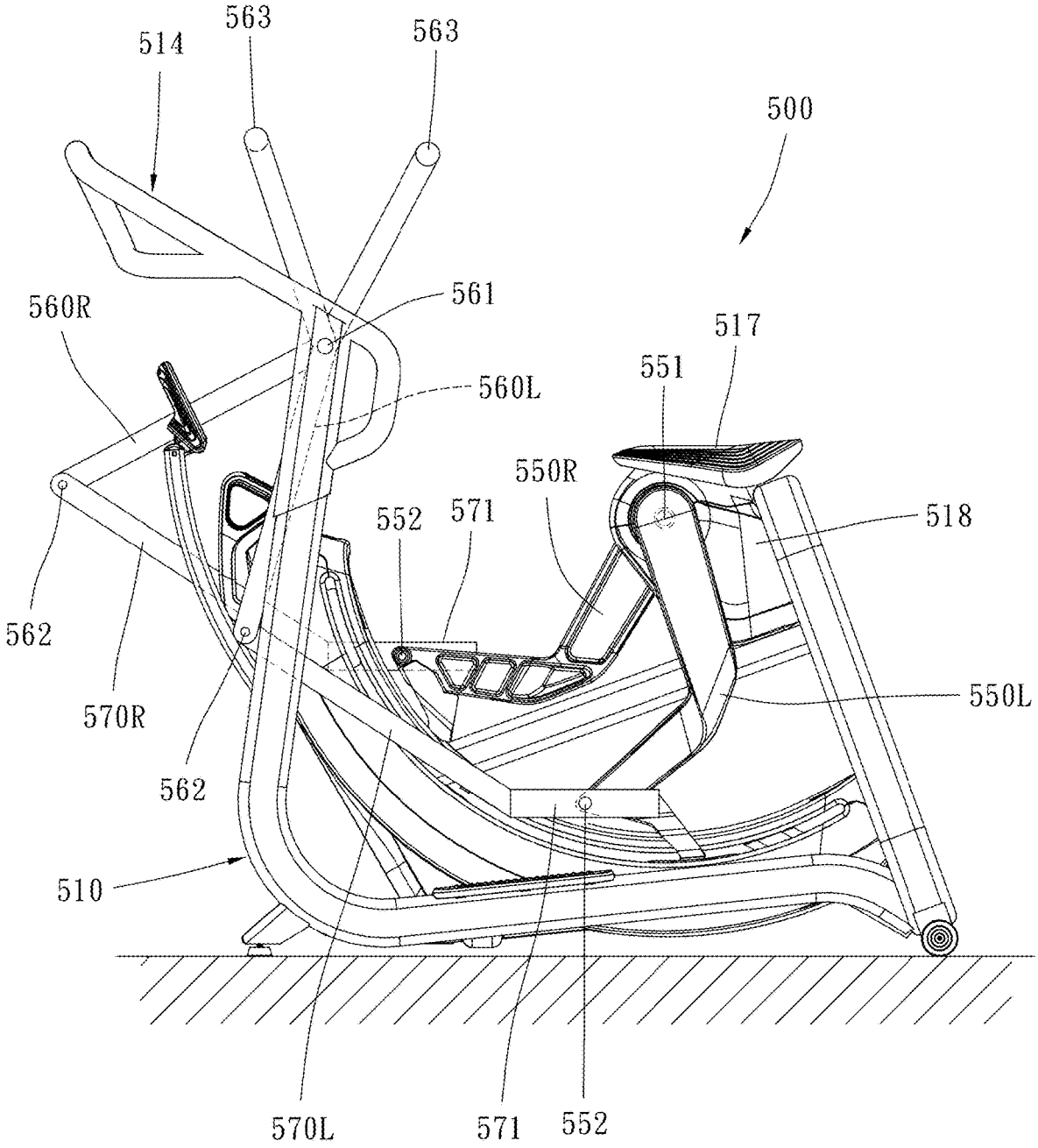
FIG. 13 is a side view of a stationary exercise apparatus in accordance with the fifth embodiment of the present disclosure.

FIG. 13 is a side view of a stationary exercise apparatus 500 according to the fifth embodiment of the present disclosure. The stationary exercise apparatus 500 is similar with the exercise apparatus 90 shown in FIG. 2. First swing elements 550L/550R are similar with the rotating arms 95L/95R in FIG. 2, a first pivot 551 is also pivotally connected to the bottom of a seat portion 517, and a linkage arrangement (not shown) is also set between the first swing elements 550L/550R so that when one of the first swing elements 550L/550R is rotating forward, the other one of the first swing elements 550L/550R is rotating rearward. Comparing to the exercise apparatus 90, a second left swing element 560L, a second right swing element 560R, a second left supporting element 570L, a second right supporting element 570R are added. Each second swing element 560L/560R is pivotally connected to a frame 510 of the stationary exercise apparatus 500 with a second pivot 561, and each supporting element 570L/570R is connected to a corresponding first swing portion 552 of the first swing element 550L/550R and a corresponding second swing portion 562 of the second swing element 560L/560R. A portion of each supporting element 570L/570R forms a supporting portion 571 for supporting the user so that the instability of the free rotating pedals as shown in FIG. 2 is avoided. The grip portions 563 formed on the top portions of the second swing elements 560L/560R are provided for the user exercising with arms and legs moving simultaneously.

The present disclosure does not require that all the advantageous features and all the advantages need to be incorporated into every embodiment thereof. Although the present disclosure has been described in considerable detail with reference to certain preferred embodiment thereof, other embodiments are possible. Therefore, the spirit and scope of the appended claims should not be limited to the description of the preferred embodiment contained herein.

What is claimed is:

1. A stationary exercise apparatus, comprising:

a frame;

a supporting member mounted on the frame and being adjustably positioned at one of a plurality of predetermined positions;

two first swing elements, each having a first pivot portion and a first swing portion, the first pivot portions of the two first swing elements respectively pivotally connected to the supporting member about a first axis, the first swing portions of the two first swing elements being pivotable about the first axis to move along a first arc path;

two second swing elements, each having a second pivot portion and a second swing portion, the second pivot portions of the two second swing elements respectively pivotally connected to the frame about a second axis, the second swing portions of the two second swing elements being pivotable about the second axis to move along a second arc path;

two supporting elements, each having a front end pivotally connected to the second swing portion of the corresponding second swing element, a rear end pivotally connected to the first swing portion of the corresponding first swing element, and a supporting portion for supporting a user and moving along a reciprocating path, wherein the reciprocating path is an arc path; and a linkage arrangement, having two connecting members each having a first end coupled to the frame to rotate about a rotating axis and a second end pivotally connected to the corresponding first swing element, wherein the supporting portions of the two supporting elements move along the reciprocating path while the first ends of the two connecting members are rotating about the rotating axis;

wherein the first axis is adjustable when the position of the supporting member is adjusted to be changed, such that the reciprocating path of the supporting portions of the two supporting elements is changed at the same time.

2. The stationary exercise apparatus of claim 1, wherein each of the two second swing elements comprises a grip portion, and the grip portion is capable of swinging along a third arc path according to the swing of the second swing portion of the second swing element.

3. The stationary exercise apparatus of claim 2, wherein when one of the supporting portions is moving forward along the reciprocating path, the corresponding grip portion is moving rearward along a third path; when one of the supporting portions is moving rearward along the reciprocating path, the corresponding grip portion is moving forward along the third path; and when the position of the supporting member relative to the frame is changed and a rear end of the reciprocating path is moved rearward, a front end of the third path is moved forward accordingly.

4. The stationary exercise apparatus of claim 1, wherein the linkage arrangement further comprises a rotating mechanism rotatably mounted on the frame about the rotating axis which is oriented laterally with respect to the frame; the first ends of the two connecting members are coupled to the rotating mechanism for moving along a circular path about the rotating axis, and the first ends of the two connecting members keep opposite to each other on the circular path; wherein the supporting portions of the two supporting elements move forward and backward between a front end and a rear end of the reciprocating path when the first ends of the two connecting members move along the circular path; and wherein when the position of the supporting member relative to the frame is adjusted to be changed, an elevation angle of the reciprocating path defined between a horizontal plane and an imaginary extending line between the front end and the rear end of the reciprocating path is changed at the same time.

5. The stationary exercise apparatus of claim 4, wherein when the supporting member is located at a first position, the front end of the reciprocating path is higher than the rear end of the reciprocating path, and the elevation angle of the reciprocating path is defined as a first path angle; when the supporting member is located at a second position, the front end of the reciprocating path is higher than the rear end of the reciprocating path, and the elevation angle of the reciprocating path is defined as a second path angle; and the first path angle is larger than the second path angle; wherein the front end of the reciprocating path when the supporting member is located at the second position is lower than that when the supporting member is located at the first position; and the rear end of the reciprocating path when the supporting member is located at the second position is more rearward than that when the supporting member is located at the first position.

6. The stationary exercise apparatus of claim 1, wherein each of the two first swing elements further comprises a linkage portion pivotally connected to the second end of the corresponding connecting member; and wherein a distance between the linkage portion and the corresponding first pivot portion is smaller than a distance between the corresponding first swing portion and the corresponding first pivot portion.

7. The stationary exercise apparatus of claim 1, wherein the supporting member has a first end pivotally coupled to the frame and a second end being adjusted to be moved forward and backward relative to the frame, the first pivot portions of the two first swing elements being pivotally connected to the second end of the supporting member about the first axis; and wherein the first axis is movable forward or backward when the second end of the supporting member is adjusted forward or backward, and the reciprocating path of the supporting portions of the two supporting elements is changed at the same time.

* * * * *